US010855029B2

(12) United States Patent
Jin

(10) Patent No.: US 10,855,029 B2
(45) Date of Patent: Dec. 1, 2020

(54) ELECTRICAL CONNECTOR ASSEMBLY

(71) Applicant: LOTES CO., LTD, Keelung (TW)

(72) Inventor: Zuo Feng Jin, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/705,465

(22) Filed: Dec. 6, 2019

(65) Prior Publication Data

US 2020/0185859 A1 Jun. 11, 2020

Related U.S. Application Data

(60) Provisional application No. 62/777,312, filed on Dec. 10, 2018.

(30) Foreign Application Priority Data

Aug. 30, 2019 (CN) ..... 2019 1 0815500

(51) Int. Cl.
*H01R 13/631* (2006.01)
*H01R 12/70* (2011.01)
(Continued)

(52) U.S. Cl.
CPC ..... *H01R 13/631* (2013.01); *H01R 12/7082* (2013.01); *H01R 12/716* (2013.01);
(Continued)

(58) Field of Classification Search
CPC .. H01R 13/193; H01R 13/631; H01R 13/112; H01R 13/639; H01R 12/7082; H01R 12/716; H01R 12/82
(Continued)

(56) References Cited

U.S. PATENT DOCUMENTS 6,716,051 B1 * 4/2004 Zeng ..... H01R 12/88 439/342
7,918,681 B2 * 4/2011 Ju ..... H05K 7/1069 439/342

(Continued)

FOREIGN PATENT DOCUMENTS

CN 2407463 Y 11/2000
CN 202068000 U 12/2011

*Primary Examiner* — Gary F Paumen
(74) *Attorney, Agent, or Firm* — Locke Lord LLP; Tim Tingkang Xia, Esq.

(57) ABSTRACT

An electrical connector includes: an insulating body; multiple terminals respectively accommodated in the insulating body; a cover covering the insulating body in a front-rear sliding manner and having a hollow portion to accommodate a mating plug including a substrate and multiple conducting portions; and a driving member. Each terminal has a contact portion. The hollow portion has a virtual center line extending in a left-right direction. The cover ihas a pulling portion located in front of the virtual center line to abut the substrate forward. The driving member has a driving portion located in front of the hollow portion. After the substrate is mounted downward into the hollow portion, the driving portion drives the cover to move horizontally forward relative to the insulating body, and the pulling portion pulls the substrate forward, such that the conducting portions move forward to be in contact with the contact portions of the terminals.

20 Claims, 23 Drawing Sheets

(51) Int. Cl.
*H01R 12/71* (2011.01)
*H01R 12/82* (2011.01)
*H01R 13/11* (2006.01)
*H01R 13/639* (2006.01)

(52) U.S. Cl.
CPC ..... *H01R 12/82* (2013.01); *H01R 13/112* (2013.01); *H01R 13/639* (2013.01)

(58) Field of Classification Search
USPC ..... 439/342
See application file for complete search history.

(56) References Cited

U.S. PATENT DOCUMENTS

| | | | | |
|---|---|---|---|---|
| 8,734,177 | B2 * | 5/2014 | Tsai | H05K 7/1061 439/342 |
| 2010/0087081 | A1 * | 4/2010 | Yuan | H05K 7/1084 439/342 |
| 2010/0190370 | A1 * | 7/2010 | Szu | H05K 7/1061 439/259 |
| 2011/0076870 | A1 * | 3/2011 | Fan | H05K 7/1007 439/342 |
| 2011/0104928 | A1 * | 5/2011 | Zhou | H05K 7/1061 439/342 |

* cited by examiner

ELECTRICAL CONNECTOR ASSEMBLY

CROSS-REFERENCE TO RELATED PATENT APPLICATION

This non-provisional application claims priority to and the benefit of, pursuant to 35 U.S.C. § 119(e), U.S. provisional patent application Ser. No. 62/777,312 filed Dec. 10, 2018 and under 35 U.S.C. § 119(a), patent application Serial No. CN201910815500.3 filed in China on Aug. 30, 2019. The disclosures of the above applications are incorporated herein in their entireties by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and in particular to an electrical connector assembly for electrically connecting a chip module to a circuit board.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

The Chinese patent No. CN201120155596.4 discloses an electrical connector for electrically connecting a chip module to a circuit board, including an electrical connection base, a cover capable of relatively sliding along the electrical connection base, and a driving mechanism for driving the cover to slide relative to the electrical connection base. The electrical connection base is provided with a circular base hole, and a top surface of the electrical connection base is provided with a conductive region. The conductive region is provided with multiple accommodating holes, and multiple terminals are respectively correspondingly accommodated in the accommodating holes. The cover slidably covers the electrical connection base, and one end thereof is provided with a perforation hole corresponding to the base hole. A top surface of the cover has a hollow portion corresponding to the conductive region, and the chip module is positioned in the hollow portion after being mounted into the electrical connector. The driving mechanism includes a rotary pin and a carrier. The rotary pin runs through the perforation hole and the base hole from top of the cover, and the carrier enters the base hole upward from bottom of the electrical connection base to match with the rotary pin. When the driving mechanism is rotated, the chip module moves together with the cover on the electrical connection base to realize electrical connection between the chip module and the circuit board.

However, during the movement of the chip module on the electrical connection base, the chip module is pushed by a rear side surface (in which a moving direction of the chip module is a forward direction, and a direction opposite to the moving direction of the chip module is a backward direction) of the hollow portion to move. The rear side surface of the hollow portion is located at the rear side of a virtual center line of the hollow portion, such that the force received by the chip module to drive it to move forward is a pushing force, which easily causes warpage of the chip module during the movement.

Therefore, a heretofore unaddressed need to design a new electrical connector exists in the art to address the aforementioned deficiencies and inadequacies.

SUMMARY

The present invention is directed to an electrical connector assembly that avoids warpage of the mating plug during the movement thereof.

In order to achieve the foregoing objective, an electrical connector according to certain embodiments of the present invention adopts the following technical solutions:

An electrical connector is configured to be electrically connected to a mating plug. The mating plug is provided with a substrate and a plurality of conducting portions protruding downward from the substrate, and the electrical connector includes: an insulating body; a plurality of terminals, respectively accommodated in the insulating body, wherein each of the terminals is provided with a contact portion; a cover, covering the insulating body in a front-rear sliding manner and having a hollow portion to accommodate the substrate, wherein the hollow portion has a virtual center line extending in a left-right direction, the cover is provided with a pulling portion to abut the substrate forward, and the pulling portion is located in front of the virtual center line; and a driving member, provided with a driving portion located in front of the hollow portion, wherein after the substrate of the mating plug is mounted downward into the hollow portion, the driving portion drives the cover to move horizontally forward relative to the insulating body, and the pulling portion pulls the substrate forward, such that the conducting portions move forward to be in contact with the contact portions of the terminals.

In certain embodiments, a left side and a right side of the hollow portion are recessed to form a plurality of concave portions, a left side and a right side of the substrate are provided with a plurality of protrusion portions correspondingly accommodated in the concave portions, a rear side surface of each of the concave portions forms the pulling portion, and the pulling portion abuts the protrusion portions in front thereof.

In certain embodiments, a rear side of the hollow portion forms an abutting portion, and when the cover moves horizontally forward, the abutting portion abuts a rear side of the substrate forward.

In certain embodiments, a left side and a right side of the hollow portion are recessed to form a plurality of notches, a left side and a right side of the substrate are provided with a plurality of projecting portions correspondingly accommodated in the notches, a front side surface of each of the notches is located behind the virtual center line, a rear side surface of each of the notches forms an abutting portion, and when the cover moves horizontally forward, the abutting portion abuts the projecting portions located in front thereof.

In certain embodiments, a left side and a right side of the hollow portion are recessed to form a plurality of recess portions, a front side surface of each of the recess portions is located in front of the virtual center line, a rear side surface of each of the recess portions is located behind the virtual center line, a left side and a right side of the substrate are provided with a plurality of projecting blocks correspondingly accommodated in the recess portions, the rear side surface of each of the recess portions forms an abutting portion, and when the cover moves horizontally forward, the abutting portion forward abuts the projecting blocks located in front thereof.

In certain embodiments, a plurality of pressing sheets are located at two opposite sides of the hollow portion, each of the pressing sheets has a pivoting portion pivotally connected to the cover and a pressing portion extending from the pivoting portion, when the substrate is to be placed in the hollow portion, the pressing sheets are rotated such that the pressing portions thereof leave the hollow portion, and after the substrate is placed in the hollow portion, the pressing sheets are rotated such that the pressing portions thereof are pressed against an upper surface of the substrate.

In certain embodiments, each of the terminals is provided with two contact portions provided opposite to each other in the left-right direction, the two contact portions extend backward and away from each other to form two guide portions, two of the terminals comprise a first terminal and a second terminal, after a respective conducting portion of the conducting portions is inserted downward between the two guide portions of a corresponding terminal of the terminals, a distance between each of the two contact portions of the first terminal and the respective conducting portion is less than a distance between each of the two contact portions of the second terminal and the respective conducting portion in a front-rear direction, and in a process of the respective conducting portion moving forward, the two contact portions of the first terminal clamp the respective conducting portion first, and then the two contact portions of the second terminal clamp the conducting portion.

In certain embodiments, the electrical connector further includes a metal member, wherein the cover is made of metal and has a horizontal flat plate portion, and a plate edge of the flat plate portion is provided with a first slide track and a second slide track respectively extending in a front-rear direction; a plate edge of the metal member is provided with a first mating edge corresponding to a left side of the first slide track and a second mating edge corresponding to a right side of the second slide track, the first slide track abuts the first mating edge leftward, and the second slide track abuts the second mating edge rightward.

In certain embodiments, the hollow portion is provided on the flat plate portion, the flat plate portion has a slide slot located behind the hollow portion, a right side of the slide slot forms the first slide track, and a left side of the slide slot forms the second slide track; the metal member has a bottom wall, the bottom wall is provided with an accommodating space to accommodate the insulating body, the bottom wall bends upward to form a rear bending portion located behind the accommodating space, the rear bending portion is accommodated in the slide slot, a right side of the rear bending portion forms the first mating edge, and a left side of the rear bending portion forms the second mating edge.

In certain embodiments, the flat plate portion has a sliding block located in front of the hollow portion, a left side of the sliding block forms the first slide track, and a right side of the sliding block forms the second slide track; the bottom wall bends upward to form a front bending portion located in front of the accommodating space, the front bending portion is provided with a slot, the sliding block is accommodated in the slot, a left side of the slot forms the first mating edge, and a right side of the slot forms the second mating edge.

In certain embodiments, the rear bending portion is provided with a through hole running through the rear bending portion in a front-rear direction, and the through hole has a top surface; and the cover is further provided with a protruding portion entering the through hole, such that the top surface of the through hole limits the cover from moving upward.

In certain embodiments, the rear bending portion bends and extends backward to form an extending portion, and the flat plate portion is provided with a stopping surface located right below the extending portion to limit the cover from moving upward.

In certain embodiments, a plurality of supporting portions protrude upward from the bottom wall, and the supporting portions support the flat plate portion upward, such that a gap is formed between the bottom wall and the flat plate portion in a vertical direction.

In certain embodiments, the terminals are configured to be soldered to a circuit board, a back plate is located below the circuit board, the metal member is fixed to the back plate by a fixing member; a sleeve accommodates the driving member, the sleeve is provided with a fixing portion fixed in the circuit board, the fixing portion extends upward to form an upper portion accommodated in the metal member, and the fixing portion extends downward to form a lower portion accommodated in the back plate.

In order to achieve the foregoing objective, an electrical connector assembly according to certain embodiments of the present invention adopts the following technical solutions:

An electrical connector assembly includes: a mating plug, provided with a substrate and a plurality of conducting portions protruding downward from the substrate; and an electrical connector, including: an insulating body; a plurality of terminals, respectively accommodated in the insulating body, wherein each of the terminals is provided with a contact portion; a cover, covering the insulating body in a front-rear sliding manner and having a hollow portion to accommodate the substrate, wherein the hollow portion has a virtual center line extending in a left-right direction, the cover is provided with a pulling portion to abut the substrate forward, and the pulling portion is located in front of the virtual center line; and a driving member, provided with a driving portion located in front of the hollow portion, wherein after the substrate of the mating plug is mounted downward into the hollow portion, the driving portion drives the cover to move horizontally forward relative to the insulating body, and the pulling portion pulls the substrate forward, such that the conducting portions move forward to be in contact with the contact portions of the terminals.

In certain embodiments, each of the terminals is provided with two contact portions provided opposite to each other in the left-right direction, the two contact portions extend backward and away from each other to form two guide portions, a front side of each of the conducting portions has an inclined surface, such that a width of each of the conducting portions gradually increases due to the inclined surface along a downward-from-top direction, after a respective conducting portion of the conducting portions is inserted downward between the two guide portions of a corresponding terminal of the terminals, the guide portions guide the respective conducting portion to move forward to the contact portions, and in a process of the respective conducting portion moving forward, the inclined surface of the respective conducting portion is in contact with the contact portions.

In certain embodiments, each of the conducting portions has a mating surface for contacting the contact portion of a corresponding terminal of the terminals, and in a downward-from-top direction, the mating surface extends obliquely toward the contact portion of the corresponding terminal.

In certain embodiments, a left side and a right side of each of the conducting portions are respectively provided with two blocking portions, and the guide portions or the contact portions of the corresponding terminal are buckled downward to the blocking portions of the respective conducting portion.

In certain embodiments, an upper surface of the substrate has a plurality of conducting regions respectively correspondingly electrically connected to the conducting portions, the conducting regions are configured to be conductively connected to a plurality of electrical conductors of a chip module correspondingly, and a distance between two adjacent ones of the conducting portions is greater than a distance between two adjacent ones of the conducting regions.

In certain embodiments, two of the conducting portions comprise a first conducting portion and a second conducting portion, a width of the first conducting portion is greater than a width of the second conducting portion in a front-rear direction, after the substrate of the mating plug is mounted downward into the hollow portion, a distance between the first conducting portion and the contact portion of a corresponding terminal of the terminals is less than a distance between the second conducting portion and the contact portion of the corresponding terminal in the front-rear direction, and in a process of the first conducting portion and the second conducting portion moving forward, the first conducting portion is in contact with the contact portion of the corresponding terminal first, and then the second conducting portion is in contact with the contact portion of the corresponding terminal.

Compared with the related art, certain embodiments of the present invention have the following beneficial effects.

The pulling portion is provided in front of the virtual center line, and the pulling portion pulls the substrate forward. That is, the force received by the substrate to drive it to move forward is a pulling force, such that the warpage of the substrate during the moving of the mating plug can be avoided.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
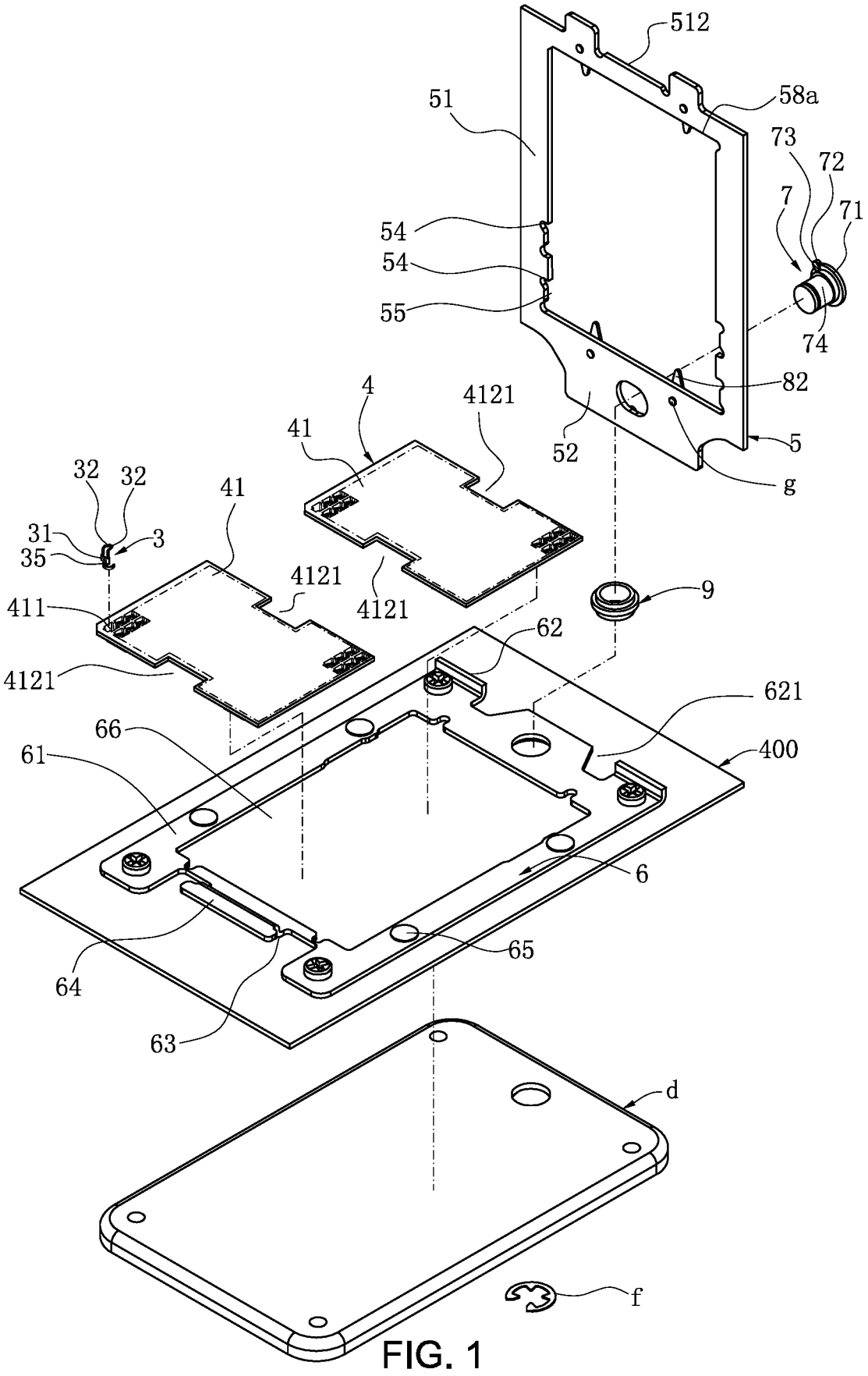
FIG. 1 is a perspective exploded view of an electrical connector assembly according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-23. In accordance with the purposes of this invention, as embodied and broadly described herein, this invention, in one aspect, relates to an electrical connector assembly.

FIGS. 1-19 shows an electrical connector assembly according to a first embodiment of the present invention, including an electrical connector 200 and a mating plug 100. The electrical connector 200 electrically connects the mating plug 100 to a circuit board 400. The mating plug 100 includes a substrate 1 and multiple conducting portions 2 provided on the substrate 1 and protruding downward from the substrate 1. A chip module 300 is supported on an upper surface of the substrate 1 and electrically connected to the substrate 1. The electrical connector 200 includes an insulating body 4; multiple terminals 3 accommodated in the insulating body 4; a cover 5 covering the insulating body 4 and capable of horizontally moving in a front-rear direction relative to the insulating body 4; a driving member 7 driving the cover 5 to move horizontally in the front-rear direction; and a metal member 6 framing the insulating body 4.

Figure 2:
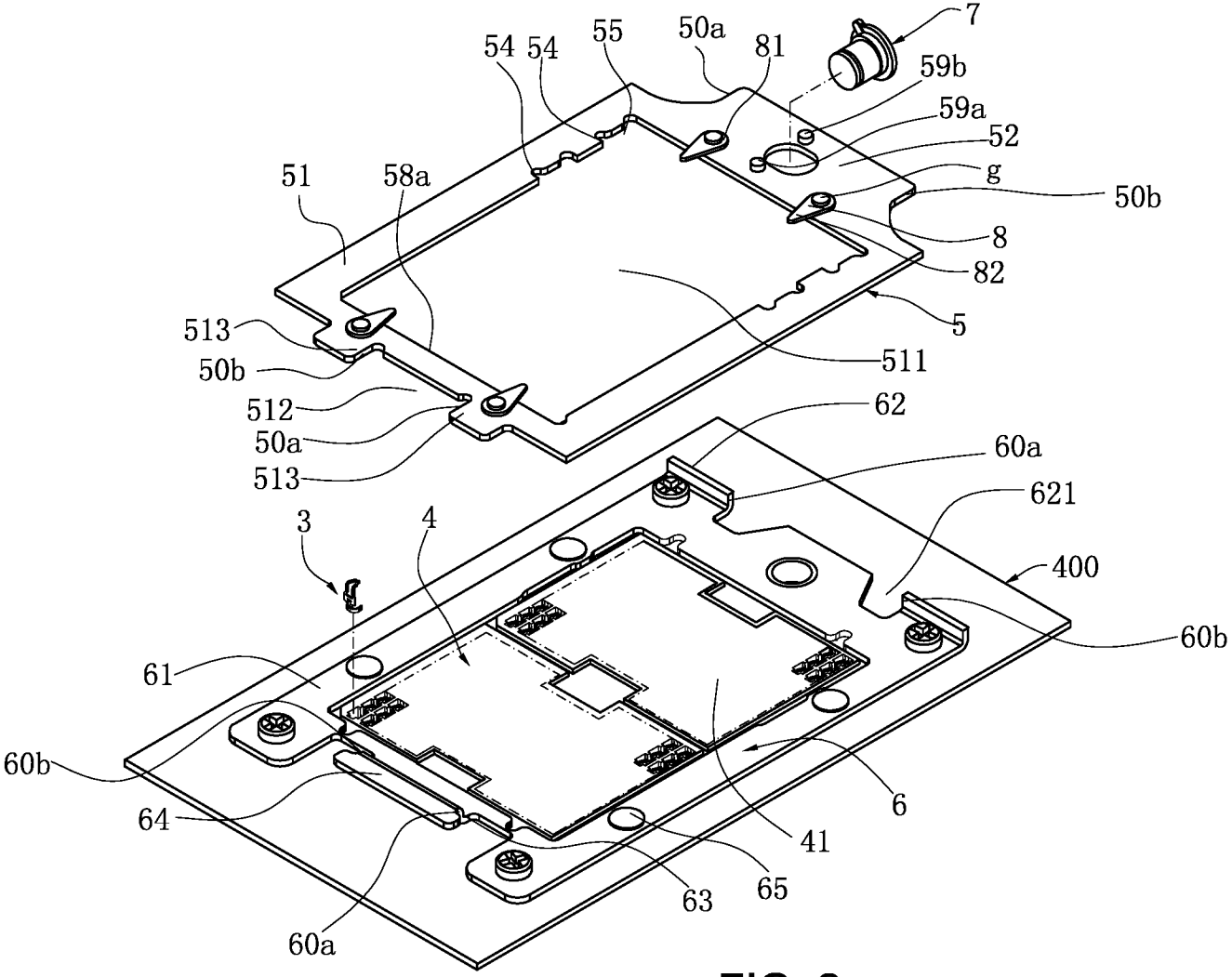
FIG. 2 is a partial perspective exploded view of FIG. 1.
Figure 16:
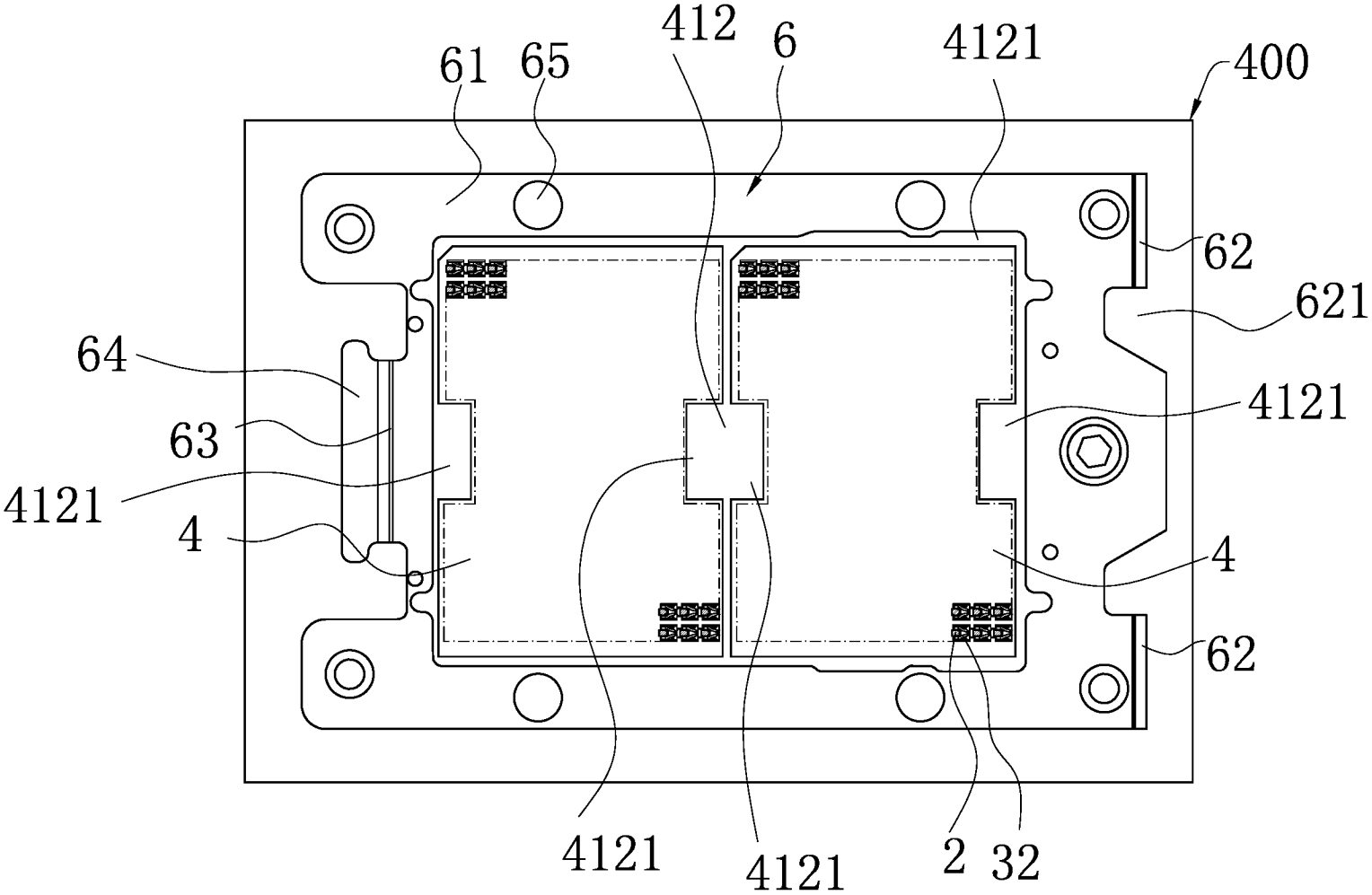
FIG. 16 is a top view of a metal member and an insulating body of the electrical connector after being assembled according to the first embodiment of the present invention.

As shown in FIGS. 1, 2 and 16, the insulating body 4 is located on the circuit board 400, and includes two body units 41 having the same structure. The two body units 41 are arranged side-by-side in the front-rear direction and along the same arranging direction. A recess 4121 is respectively recessed from each of a front side and a rear side of each of the body units 41. The recess 4121 at the rear side of the body unit 41 at the front and the recess 4121 at the front side of the body unit 41 at the rear form a frame opening 412 altogether, such that the insulating body 4 has a hollow structure. The arrangement positions of the two body units 41 may be switchable, and the frame opening 412 defined after the switch remains unchanged. Multiple accommodating holes 411 run vertically through each of the body units 41 to accommodate the terminals 3, and the terminals 3 accommodated in the accommodating holes 411 of the body unit 41 at the front and the terminals 3 accommodated in the accommodating holes 411 of the body unit 41 at the rear are arranged in the same direction.

Figure 7:
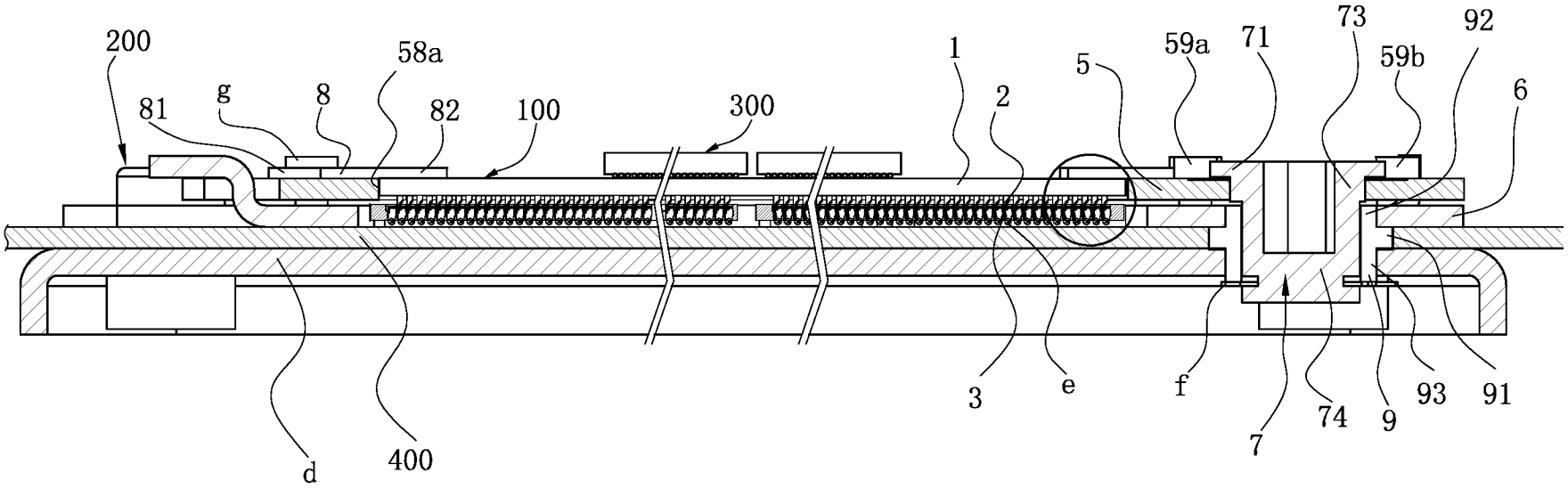
FIG. 7 is a sectional view of FIG. 6 along line A-A.
Figure 8:
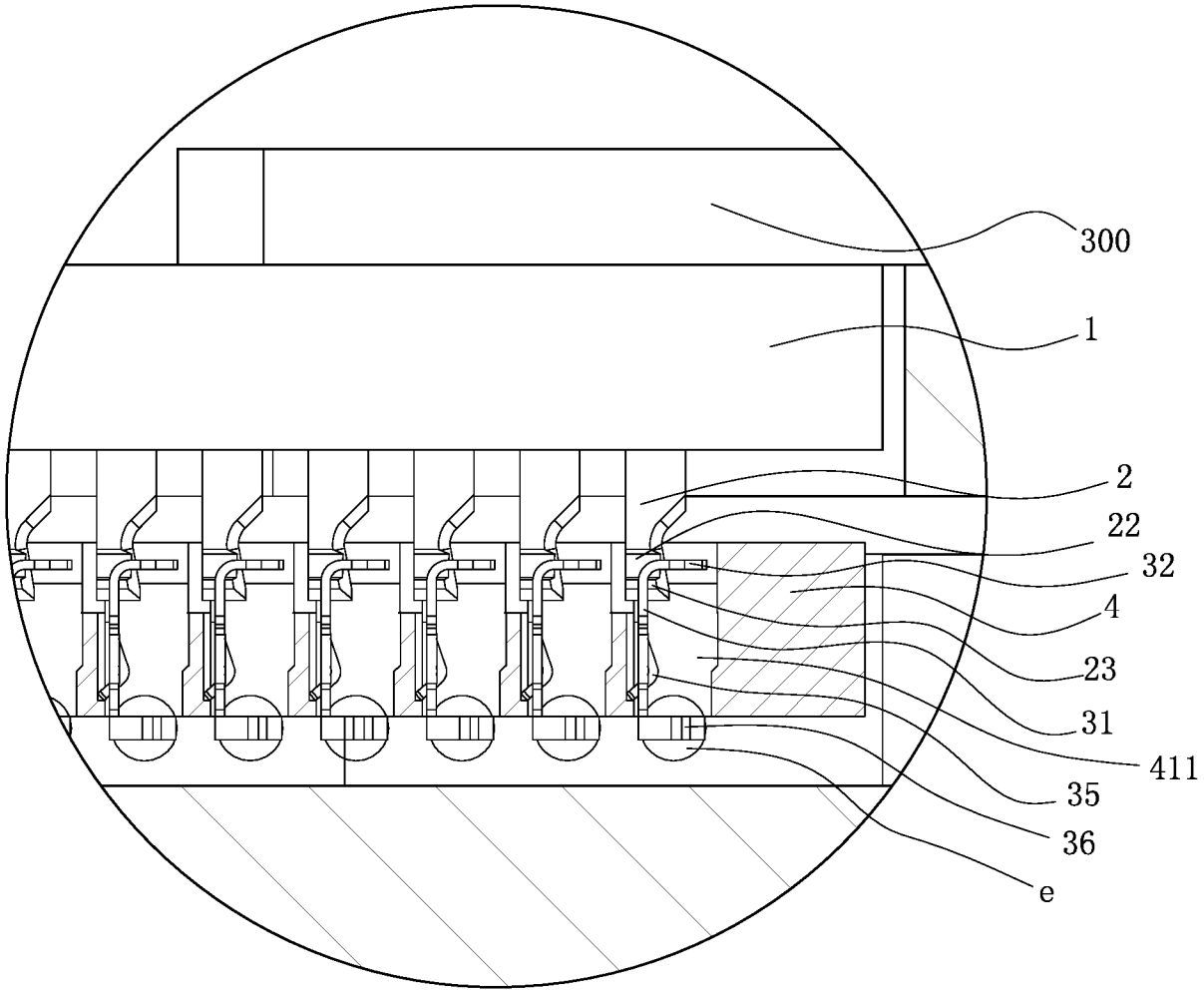
FIG. 8 is a partial enlarged view of FIG. 7.
Figure 9:
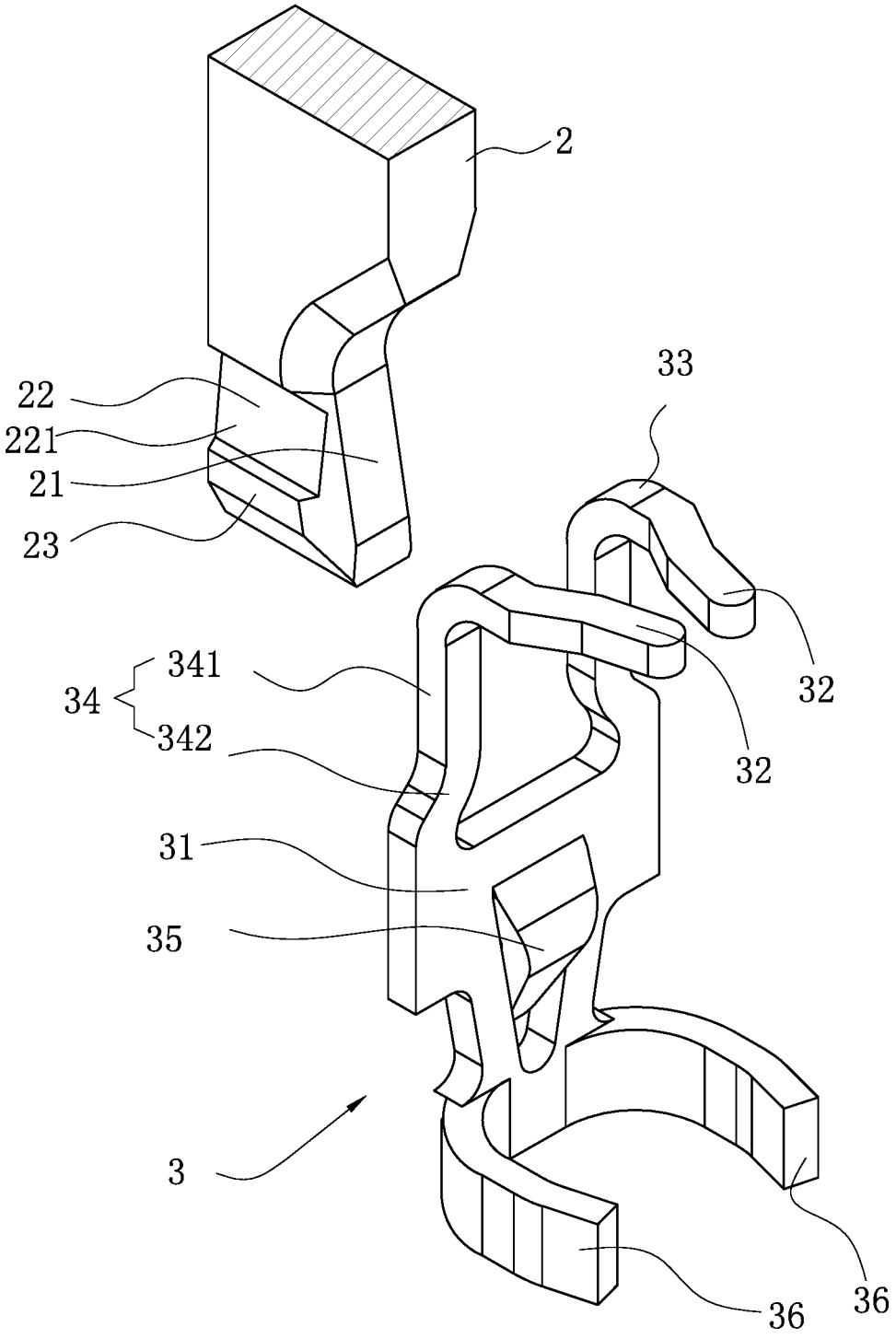
FIG. 9 is an exploded schematic view of a conducting portion and a terminal according to the first embodiment of the present invention.

As shown in FIGS. 1, 2 and 9, each terminal 3 has a base 31 having a flat plate shape. A plate surface of the base 31 is perpendicular to the front-rear direction. The base 31 extends upward to form two elastic portions 34, and the two elastic portions 34 and the base 31 are located on the same plane. Each of the elastic portions 34 bends and extends forward to form a guide portion 33, and the guide portion 33 bends and extends forward to form a contact portion 32. A distance between the two guide portions 33 of each terminal 3 is greater than a distance between the two contact portions 32. Each of the elastic portions 34 has a first portion 341 connected to the base 31 and a second portion 342 extending upward from the first portion 341 to be connected to the guide portion 33. A distance between the two second portions 342 of each terminal 3 is identical, and a distance between the two first portions 341 of each terminal 3 gradually decreases from the base 31 toward the second portion 342. The base 31 bends downward and forward and then bends backward to form a position limiting portion 35 abutting an inner wall of the accommodating hole 411 downward to limit the terminal 3 from moving downward. The position limiting portion 35 protrudes from a front side and a rear side of the base 31. A left side and a right side of the base 31 bend and extend forward to form two clamping arms 36 to clamp a solder e, and the solder e is used to be soldered to the circuit board 400 (as shown in FIGS. 7 and 8).

Figure 3:
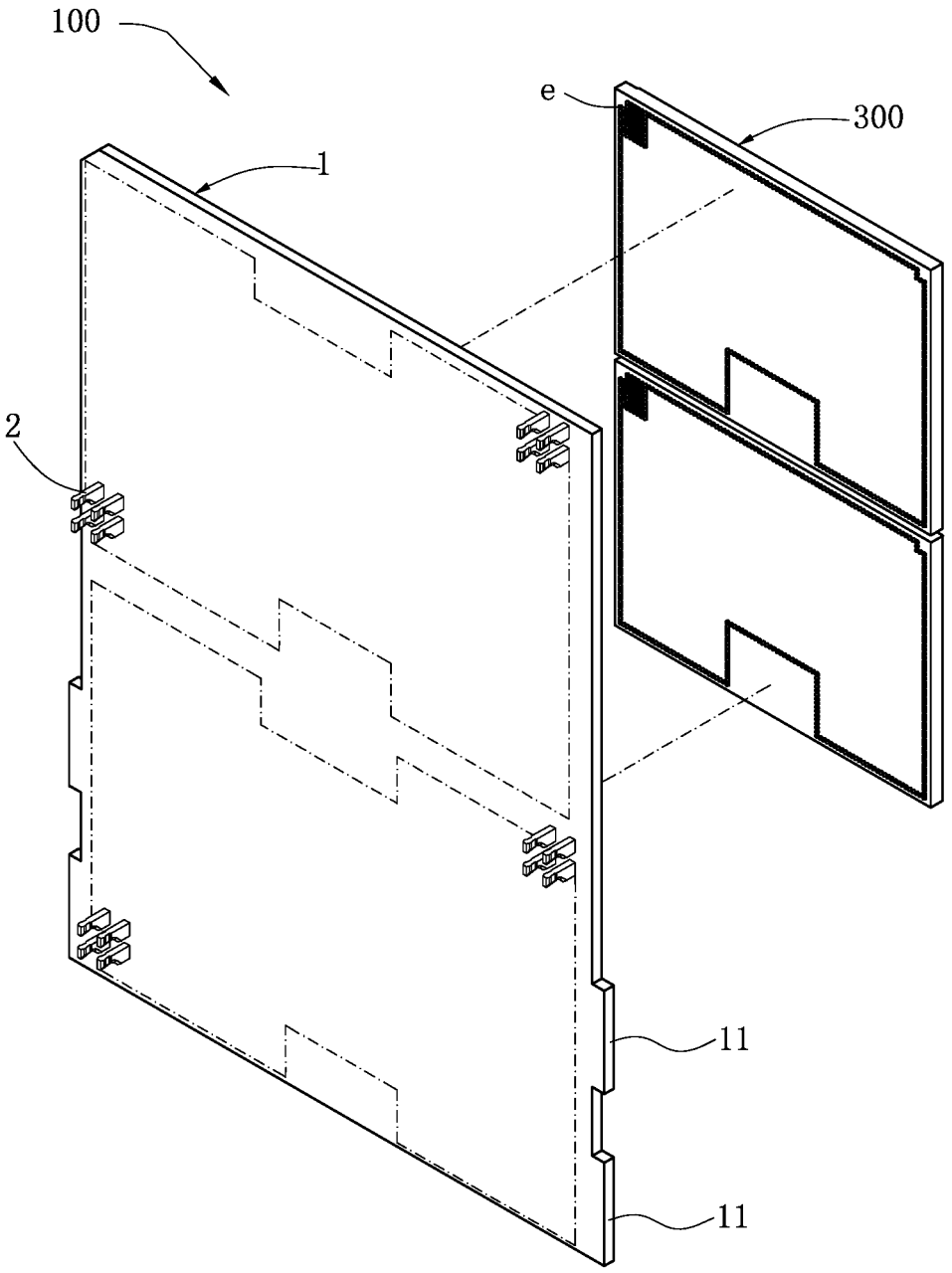
FIG. 3 is an exploded schematic view of a mating plug and a chip module according to the first embodiment of the present invention.
Figure 6:
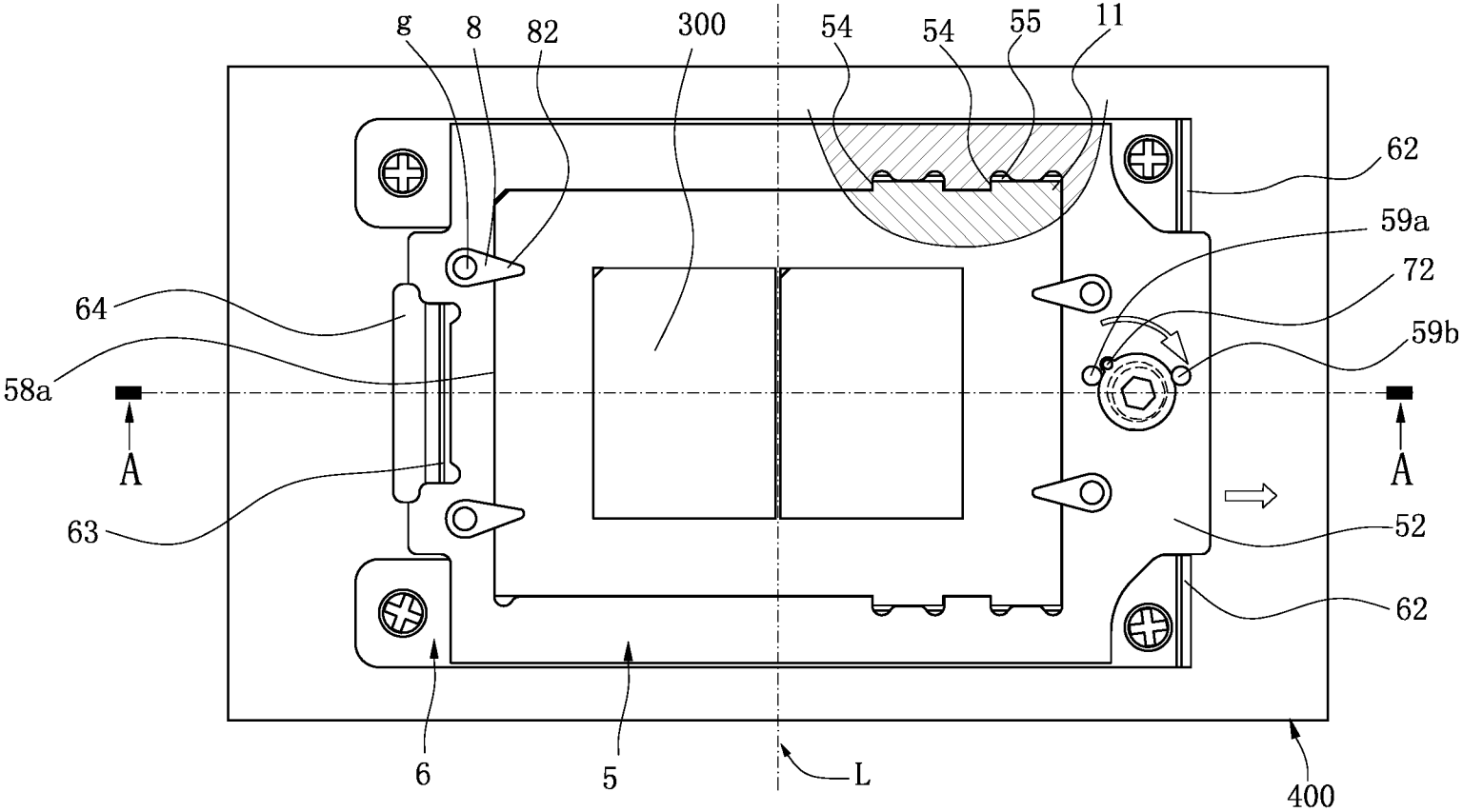
FIG. 6 is a top view of FIG. 5.
Figure 13:
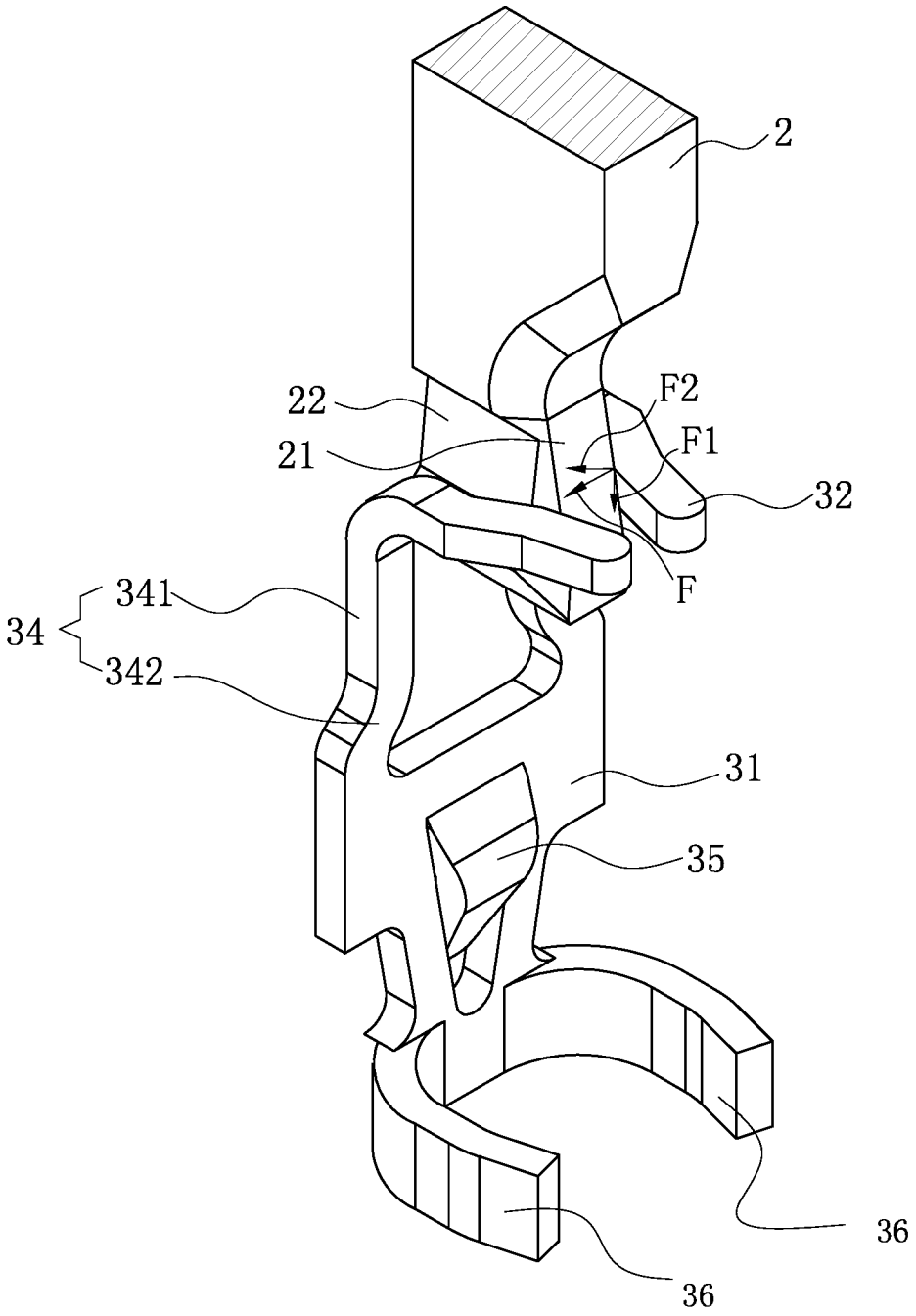
FIG. 13 is a schematic view of a conducting portion during moving and a terminal according to the first embodiment of the present invention.
Figure 14:
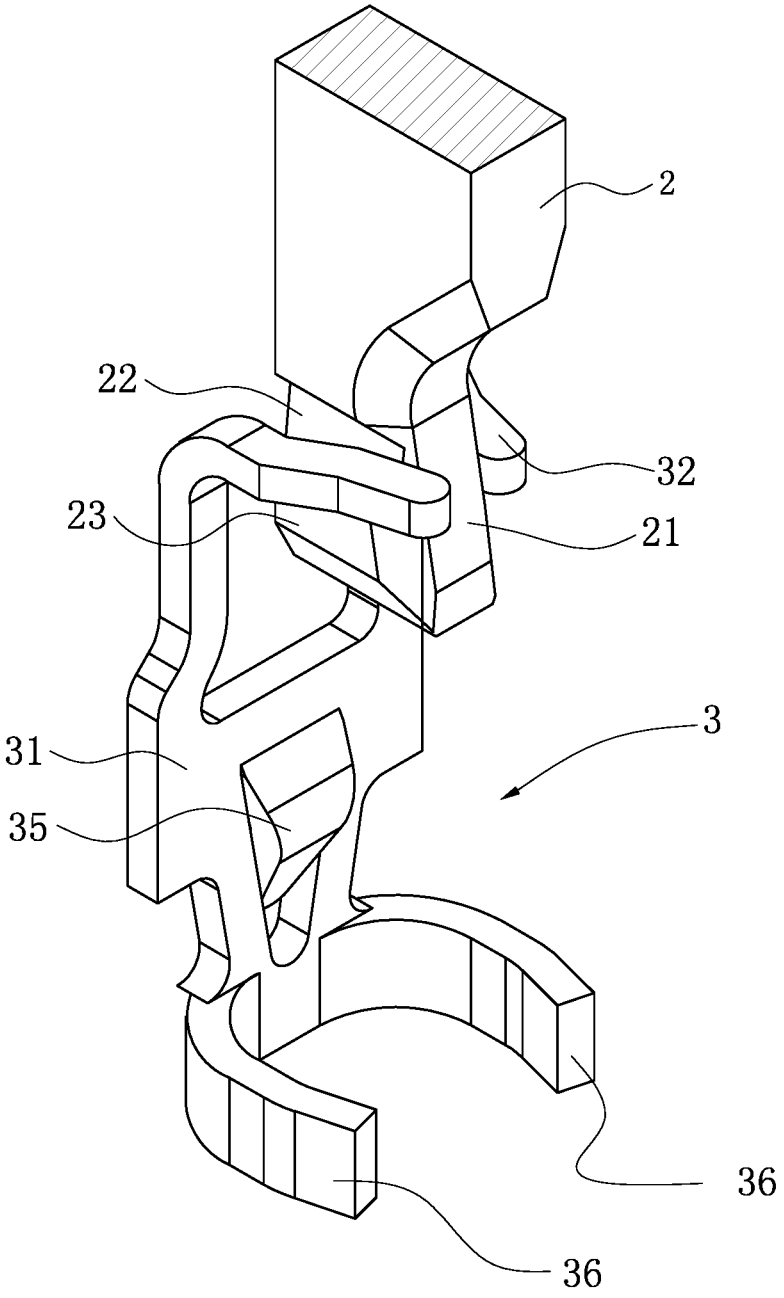
FIG. 14 is a schematic view of the conducting portion moving to the final position and clamped by the terminal according to the first embodiment of the present invention.
Figure 15:
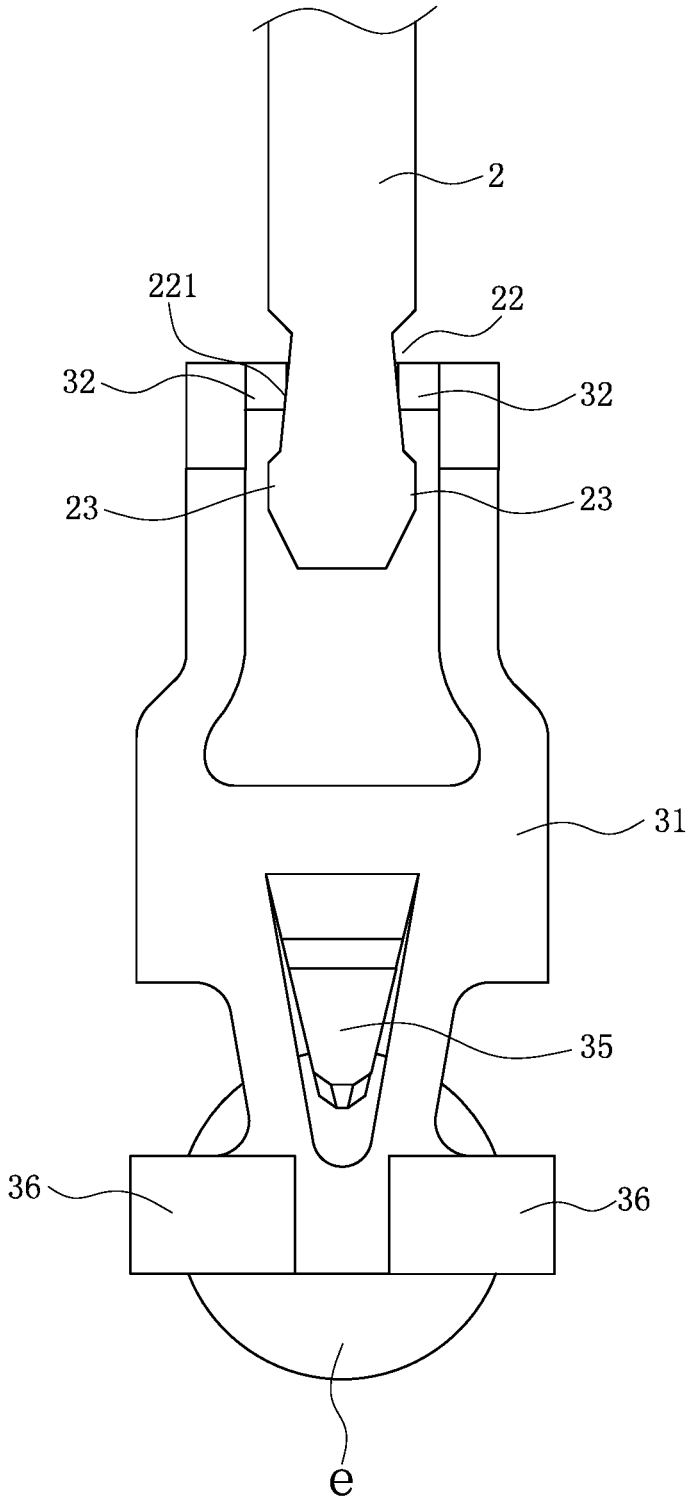
FIG. 15 is a schematic view of the terminal clamping the conducting portion of FIG. 14 from another viewing angle.
Figure 17:
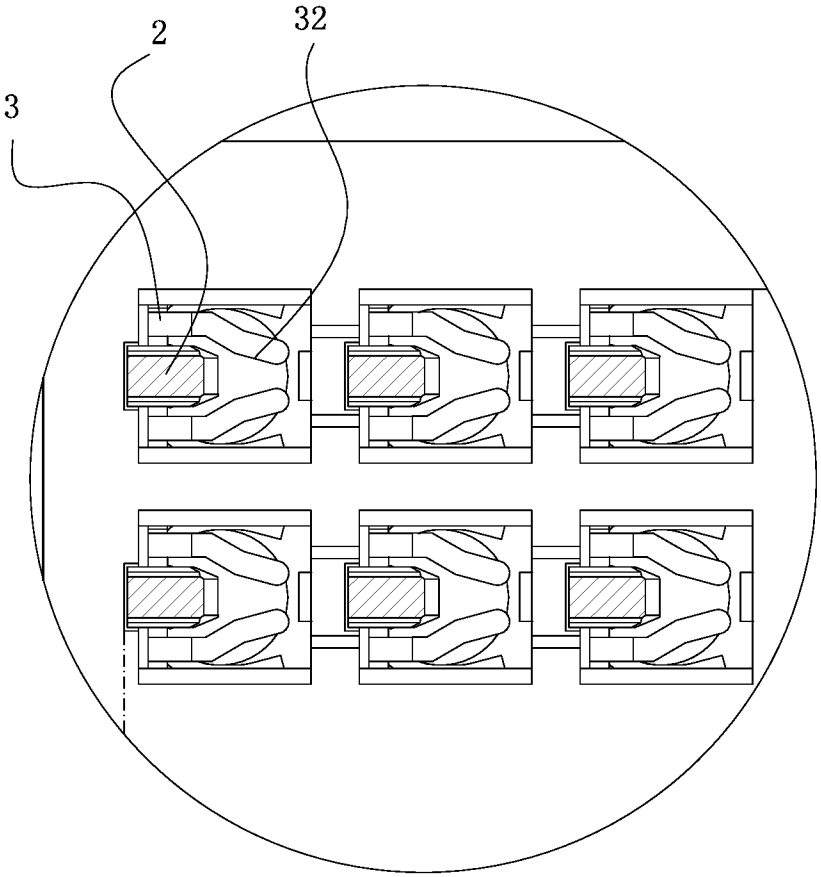
FIG. 17 is a top view of the conducting portion being inserted downward into the terminal according to the first embodiment of the present invention.
Figure 18:
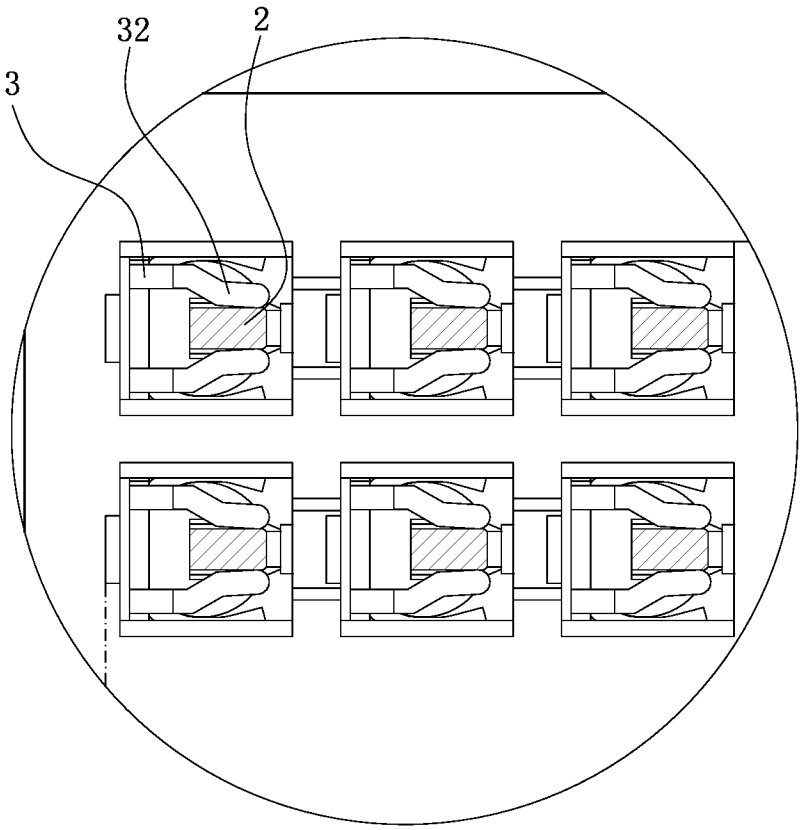
FIG. 18 is a top view of the conducting portion horizontally moving to the final position and clamped by the terminal according to the first embodiment of the present invention.
Figure 19:
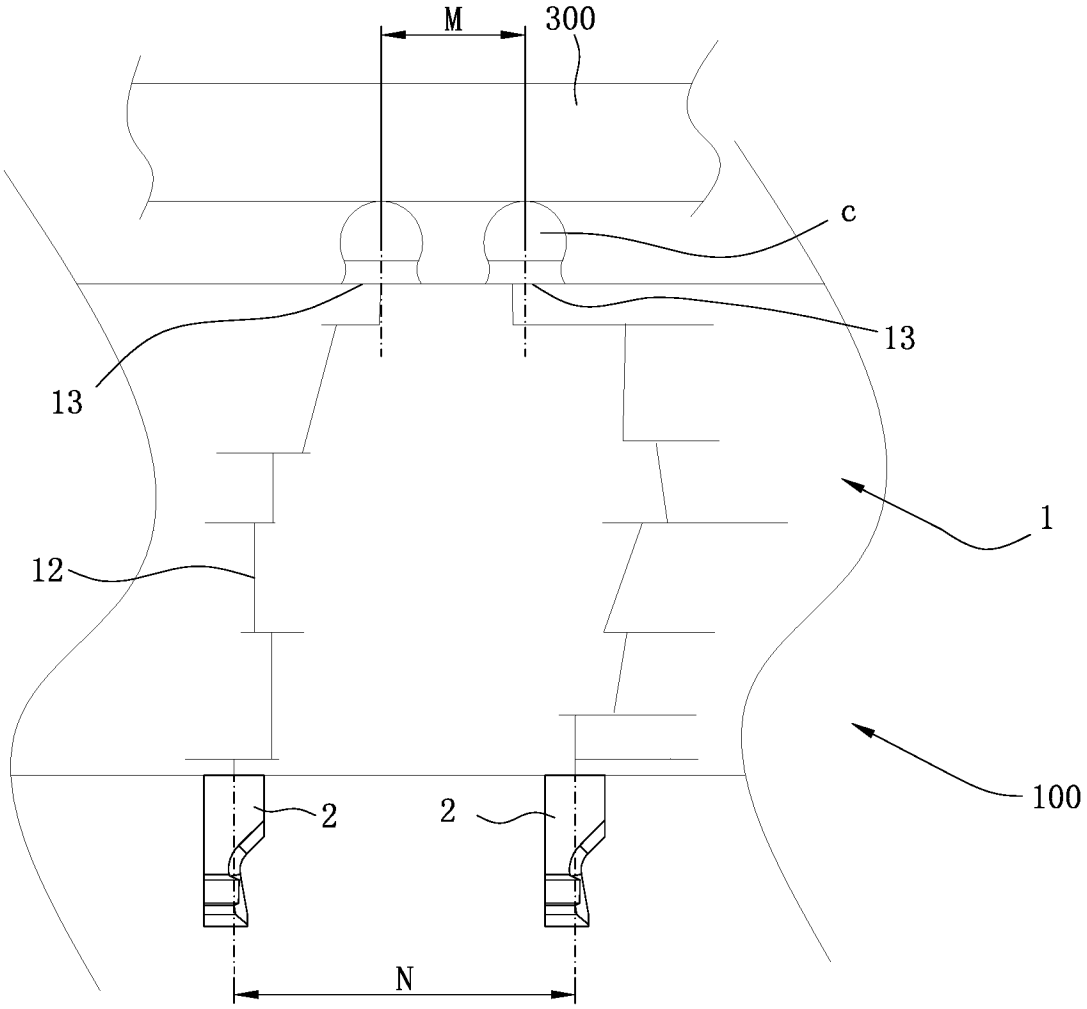
FIG. 19 is a schematic view of the mating plug being connected to the chip module according to the first embodiment of the present invention.

As shown in FIGS. 3, 6 and 19, the substrate 1 is located above the insulating body 4, and has a multi-layered printed circuit 12 between an upper surface and a lower surface thereof. A left side and a right side of the substrate 1 are respectively provided with two protrusion portions 11, and the upper surface of the substrate 1 further has multiple conducting regions 13. The chip module 300 has multiple electrical conductors c correspondingly conducted to the conducting region 13 respectively. In this embodiment, the electrical conductor c is a solder ball. In other embodiments, the chip module 300 may not be soldered on the substrate 1, and the chip module 300 may be crimped on the substrate 1. A thickness of each conducting portion 2 in a left-right direction is less than the minimum distance between the two guide portions 33 of each of the terminals 3, such that the conducting portion 2 is inserted between the two guide portions 33 with zero insertion force. The conducting region 13 is correspondingly electrically connected to the conducting portion 2 through the multi-layered printed circuit 12, such that each of the electrical conductors c is electrically conductively connected to the corresponding conducting portion 2. A distance M between two adjacent conducting portions 2 is greater than a distance N between two adjacent conducting regions 13, such that there is sufficient space for providing the terminals 3 having the same quantity as that of the electrical conductors c. As shown in FIGS. 13, 14 and 17, a front side of each conducting portion 2 has an inclined surface 21, and the inclined surface 21 gradually increases the width of the conducting portion 2 in a downward-from-top direction. After the conducting portion 2 is inserted downward between the two guide portions 33 of the corresponding terminal 3, the guide portions 33 guide the conducting portion 2 to move forward to the contact portions 32. During the forward moving of the conducting portion 2, the inclined surface 21 is in contact with the contact portions 32, and a downward component force F1 is formed to act on the inclined surface 21, such that the mating plug 100 is prevented from floating upward. As shown in FIG. 15, a left side and a right side of the conducting portion 2 are respectively provided with two grooves 22, the contact portions 32 clamp the grooves 22, and each groove 22 has a mating surface 221 to be in contact with the corresponding contact portion 32. In the downward-from-top direction, the mating surface 221 extends obliquely toward the corresponding contact portion 32. That is, in the downward-from-top direction, the two mating surfaces 221 of each of the conducting portions 2 are gradually separated from each other. During the forward moving of the conducting portion 2, a downward component force is formed to act on the mating surface 221 to further prevent the mating plug 100 from floating upward. A lower end of each groove 22 forms a blocking portion 23. During the forward moving of the conducting portion 2 or when the conducting portion 2 is clamped by the corresponding terminal 3, the guide portions 33 or the contact portions 32 are buckled downward to the blocking portions 23 to prevent the mating plug 100 from moving upward.

As shown in FIGS. 1, 2 and 6, the cover 5 is made of metal, and the cover 5 has a flat plate portion 51. The flat plate portion 51 is provided with a hollow portion 511 which runs through an upper surface and a lower surface thereof to accommodate the substrate 1, and the hollow portion 511 has a virtual center line extending along a left-right direction. A plate edge of the flat plate portion 51 is provided with two first slide tracks 50*a* and two second slide tracks 50*b* extending in the front-rear direction, and the flat plate portion 51 has a slide slot 512 located behind the hollow portion 511. One of the first slide tracks 50*a* is provided on a right side of the slide slot 512, and one of the second slide tracks 50*b* is provided on a left side of the slide slot 512. The flat plate portion 51 is provided with a sliding block 52 located in front of the hollow portion 511. The other first slide track 50*a* is provided on a left side of the sliding block 52, and the other second slide track 50*b* is provided on a right side of the sliding block 52. The flat plate portion 51 is respectively provided with two pulling portions 54 at a left side and a right side of the hollow portion 511, and the pulling portion 54 is located in front of the virtual center line L of the hollow portion 511. A left side surface and a right side surface of the hollow portion 511 are respectively recessed to form two concave portions 55, and each of the concave portions 55 correspondingly accommodates each of the protrusion portions 11. A front side of the concave portion 55 forms the pulling portion 54, and the pulling portion 54 abuts a rear side surface of the protrusion portions 11 in front thereof. A rear side surface of the hollow portion 511 forms a first abutting portion 58*a* abutting a rear side of the substrate 1. A first stopping position 59*a* and a second stopping position 59*b* are soldered to an upper surface of the cover 5. In other embodiments, the first stopping position 59*a* and the second stopping position 59*b* may also be integrally formed with the cover 5.

Figure 4:
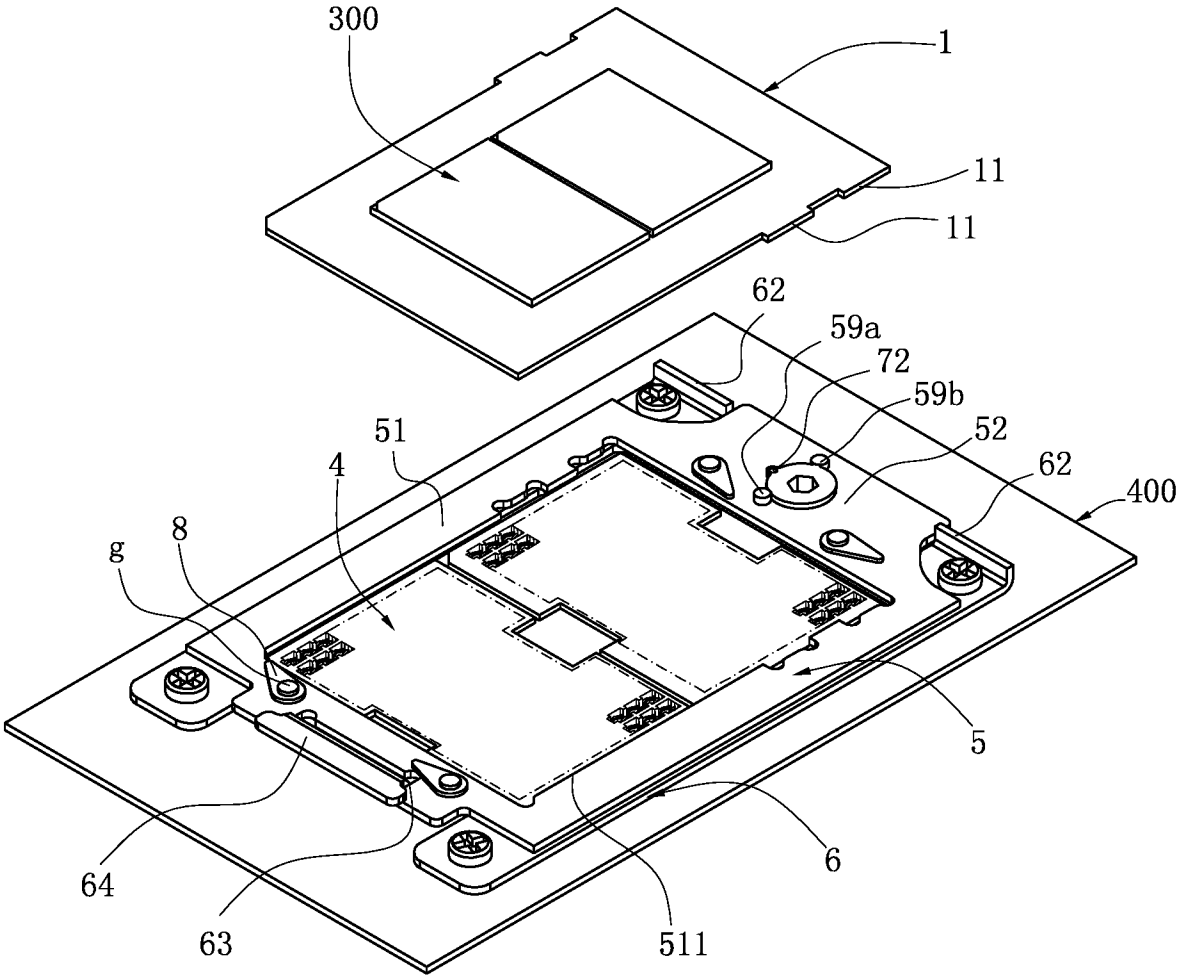
FIG. 4 is a perspective view of the chip module and the mating plug before being assembled to the electrical connector according to the first embodiment of the present invention.
Figure 5:
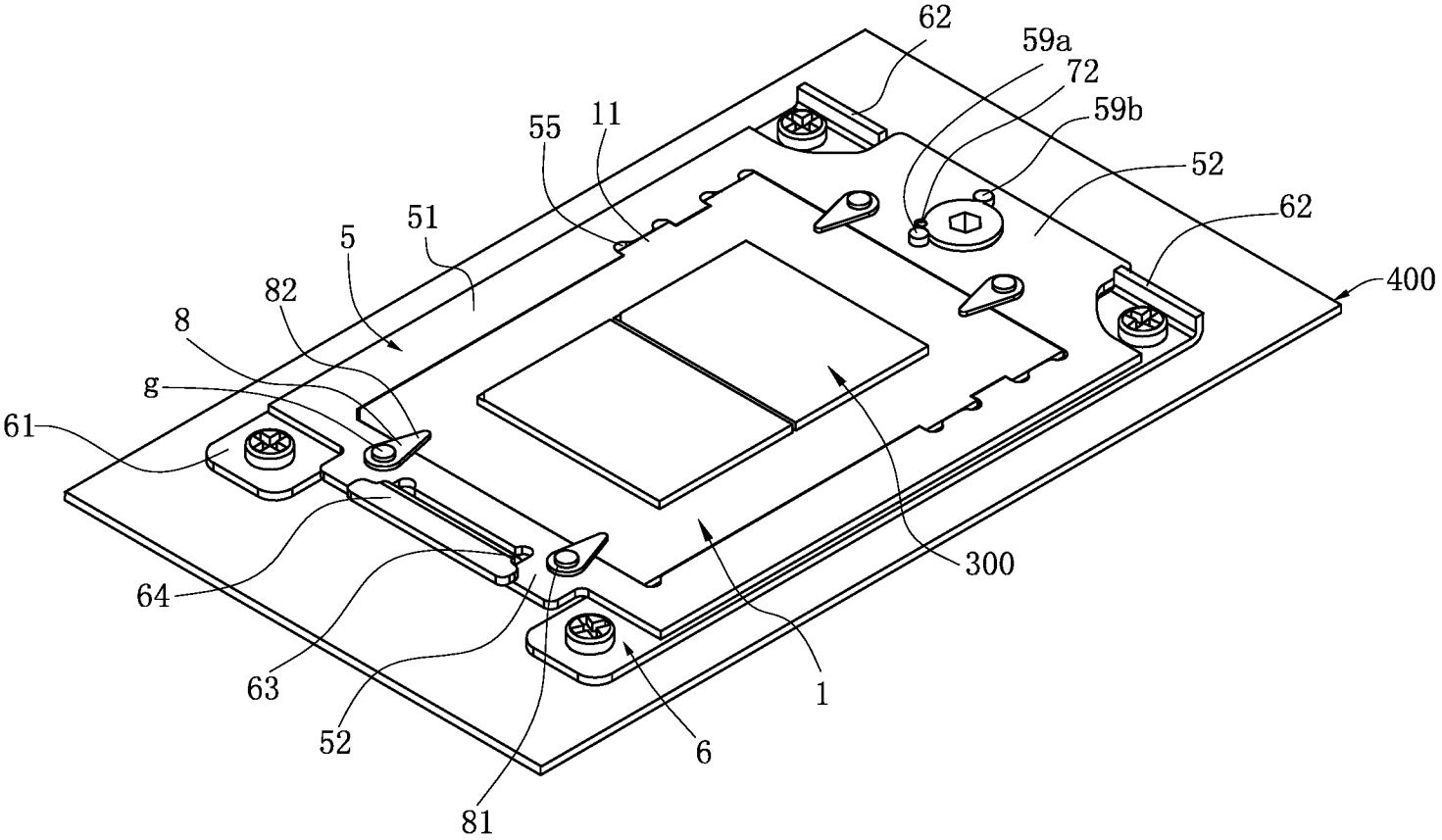
FIG. 5 is a perspective view of the chip module and the mating plug after being assembled to the electrical connector according to the first embodiment of the present invention.

As shown in FIGS. 4 and 5, a front side and a rear side of the hollow portion 511 are respectively provided with two pressing sheets 8. In other embodiments, the front and rear sides of the hollow portion 511 may also be respectively provided with one pressing sheet 8, or the pressing sheets 8 may also be provided on the left and right sides of the hollow portion 511. Each pressing sheet 8 is made of metal, and has a pivoting portion 81. A rivet g is fixed to the cover 5, and the pivoting portion 81 is pivotally connected to the rivet g such that the pivoting portion 81 is pivotally connected to the cover 5. In other embodiments, the pressing sheet 8 may also be directly pivotally connected to the cover 5. A pressing portion 82 extends from the pivoting portion 81. When the substrate 1 is to be placed in the hollow portion 511, the pressing sheets 8 are rotated such that the pressing portions 82 leave the hollow portion 511, and after the substrate 1 is placed in the hollow portion 511, the pressing sheets 81 are rotated such that the pressing portions 82 are pressed against an upper surface of the substrate 1.

As shown in FIGS. 1, 2 and 5, the metal member 6 has a bottom wall 61, and four screws run downward through the bottom wall 61 to fix the bottom wall 61 to a back plate d. The back plate d is located on a lower surface of the circuit board 400. The bottom wall 61 is provided with an accommodating space 66, and the two body units 41 are provided side-by-side in the accommodating space 66. A plate edge of the metal member 6 is provided with two first mating edges 60*a* corresponding to the left sides of the two first slide tracks 50*a* and two second mating edges 60*b* corresponding to the right sides of the second slide tracks 50*b*. The first slide tracks 50*a* abut the first mating edge 60*a* leftward, and the second slide tracks 50*b* abut the second mating edge 60*b* rightward to prevent the cover 5 from deviating leftward or rightward during the front-rear sliding. In this embodiment, a front side of the bottom wall 61 bends upward to form a front bending portion 62 located in front of the accommodating space 66. The front bending portion 62 is provided with a slot 621, and the slot 621 divides the front bending portion 62 into two portions side-by-side in a left-right direction. The sliding block 52 is accommodated in the slot 621. A left side of the slot 621 forms one of the first mating edges 60*a* corresponding to the first slide track 50*a* formed on the left side of the sliding block 52, and a right side of the slot 621 forms one of the second mating edges 60*b* corresponding to the second slide track 50*b* formed on the right side of the sliding block 52. The bottom wall 61 bends upward to form a rear bending portion 63 located behind the accommodating space 66. The rear bending portion 63 is accommodated in the slide slot 512. A right side of the rear bending portion 63 forms the other first mating edge 60*a* corresponding to the first slide track 50*a* formed on the right side of the slide slot 512, and the left side of the rear bending portion 63 forms the other second mating edge 60*b* corresponding to the second slide track 50*b* formed on the left side of the slide slot 512. The rear bending portion 63 bends and extends backward to form an extending portion 64, and the flat plate portion 51 is provided with a stopping surface 513 located right below the extending portion 64 to limit the cover 5 from moving upward. Multiple supporting portions 65 protrude upward from the bottom wall 61, and the supporting portions 65 support the flat plate portion 51 upward, such that a gap is formed between the bottom wall 61 and the flat plate portion 51 in a vertical direction for heat dissipation. In this embodiment, each supporting portion 65 is in a cylindrical shape.

Figure 10:
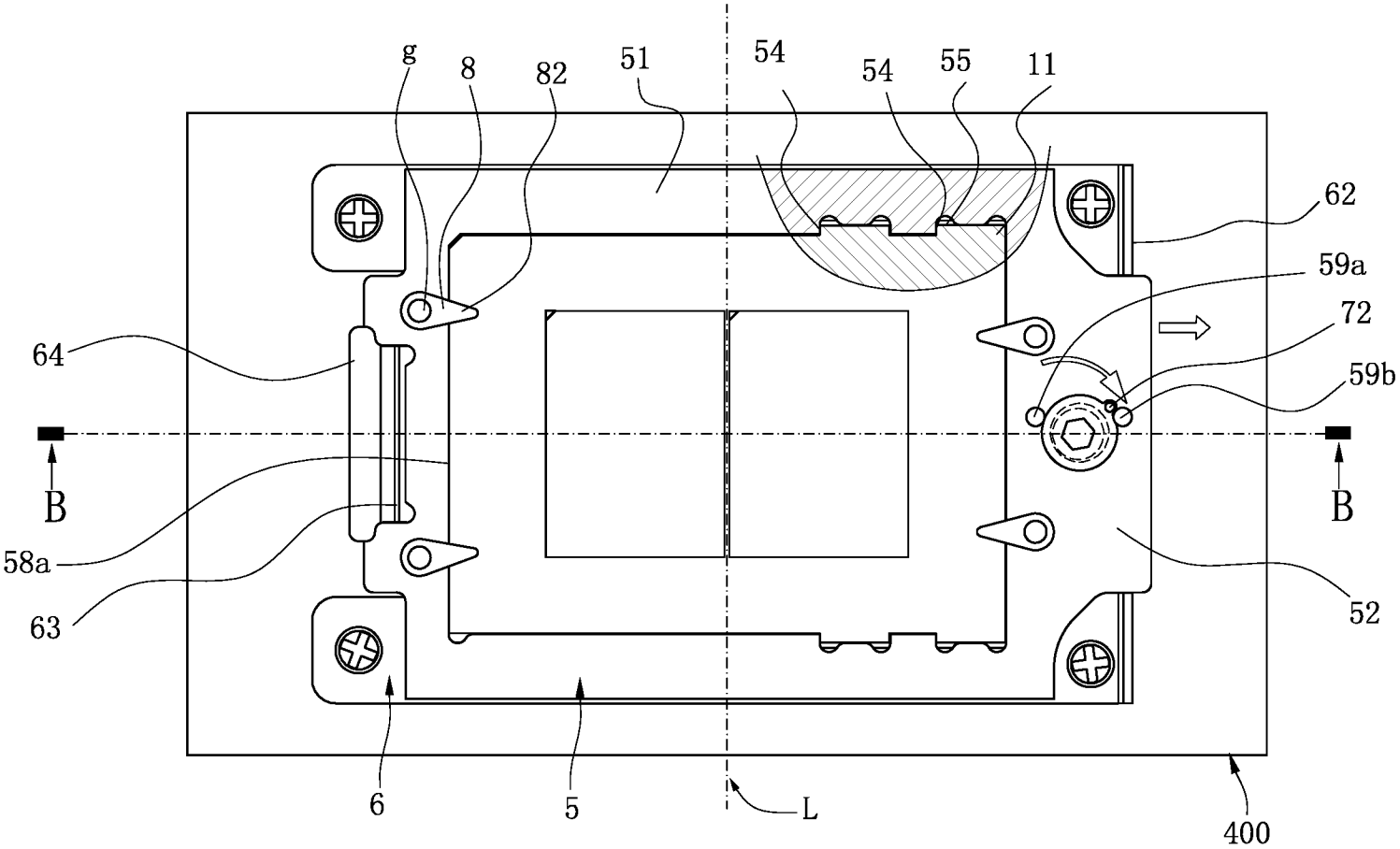
FIG. 10 is a schematic view of the mating plug moving to the final position according to the first embodiment of the present invention.
Figure 11:
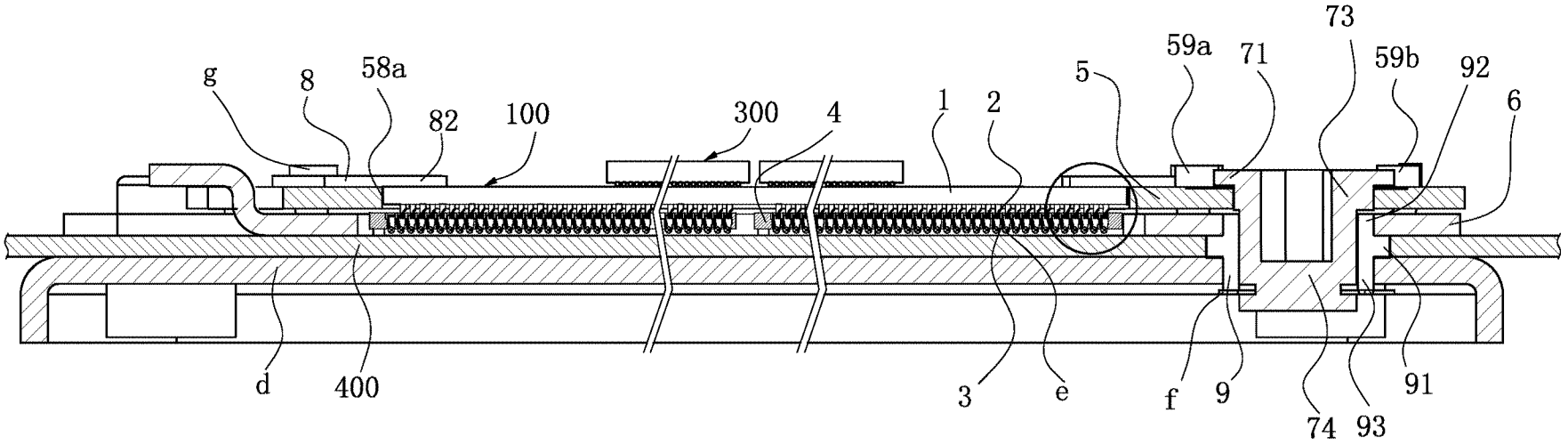
FIG. 11 is a sectional view of FIG. 10 along line B-B.
Figure 12:
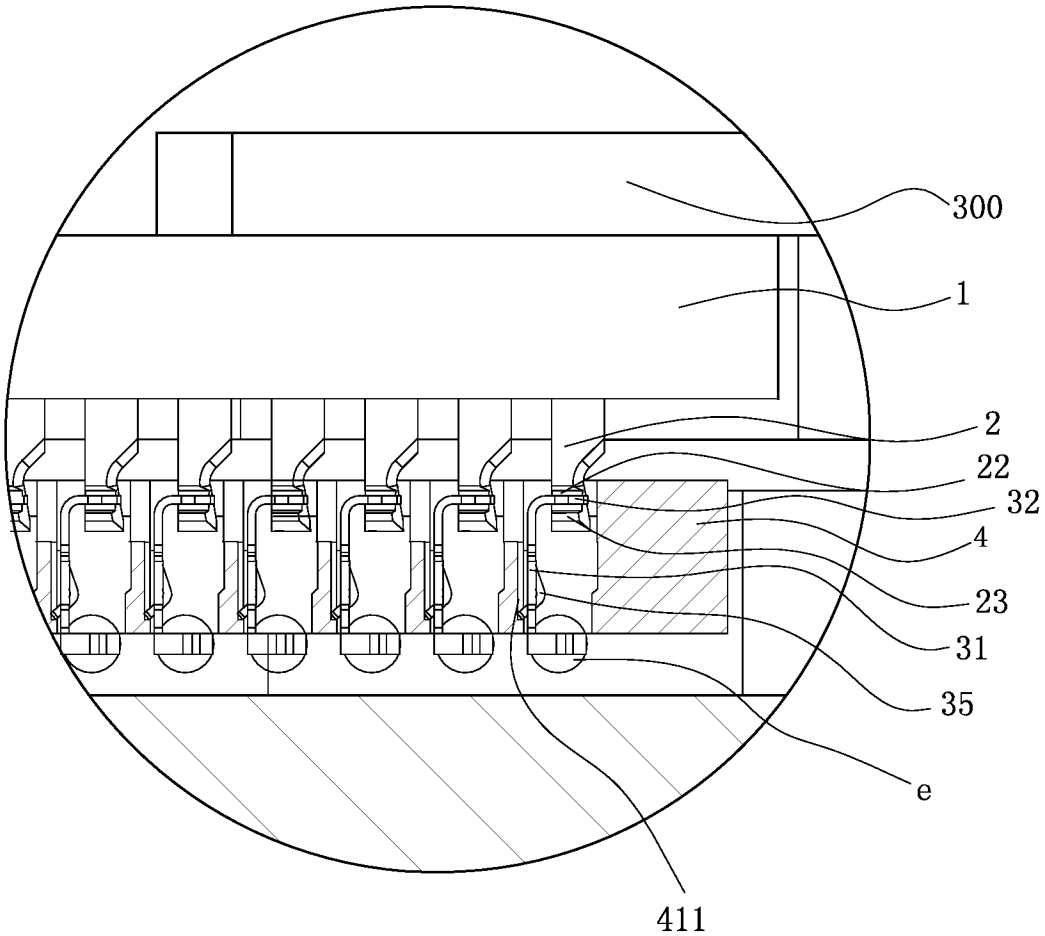
FIG. 12 is a partial enlarged view of FIG. 11.

As shown in FIGS. 6, 7 and 10, the driving member 7 is a cam made of metal, and is located in front of the hollow portion 511. The driving member 7 has a head portion 71 abutting the upper surface of the cover 5, and a protruding block 72 extending outward from the head portion 71. The protruding block 72 rotates horizontally between the first stopping position 59*a* and the second stopping position 59*b*. A driving portion 73 extends downward from the head portion 71 and is accommodated in the cover 5. A column 74 extends downward from the driving portion 73 and is accommodated in the metal member 6. The center of the driving portion 73 is offset from the center of the head portion 71 and the column 74. A portion of the column 74 protruding from the back plate d is provided with a clamping slot (not shown) to be fastened with a clamping ring f to prevent the driving member 7 from moving upward. A sleeve 9 accommodates the driving member 7. The sleeve 9 is made of metal, and is provided with a fixing portion 91 fixed in the circuit board 400. The fixing portion 91 extends upward to form an upper portion 92 accommodated in the bottom wall 61, and the fixing portion 91 extends downward to form a lower portion 93 accommodated in the back plate d. When the protruding block 72 rotates from the first stopping position 59*a* toward the second stopping position 59*b*, the driving portion 73 abuts the cover 5 forward and the pulling portion 54 pulls the substrate 1, such that the cover 5 moves horizontally forward altogether with the substrate 1, so as to drive the conducting portions 2 to move forward from the guide portions 33 to the contact portions 32. When the protruding block 72 rotates from the second stopping position 59*b* toward the first stopping position 59*a*, the driving portion 73 abuts the cover 5 backward to drive the substrate 1 to move horizontally backward, such that the conducting portions 2 are driven to move from the contact portions 32 to the guide portions 33. Thus, each conducting portion 2 is separated from the contact portions 32.

Figure 20:
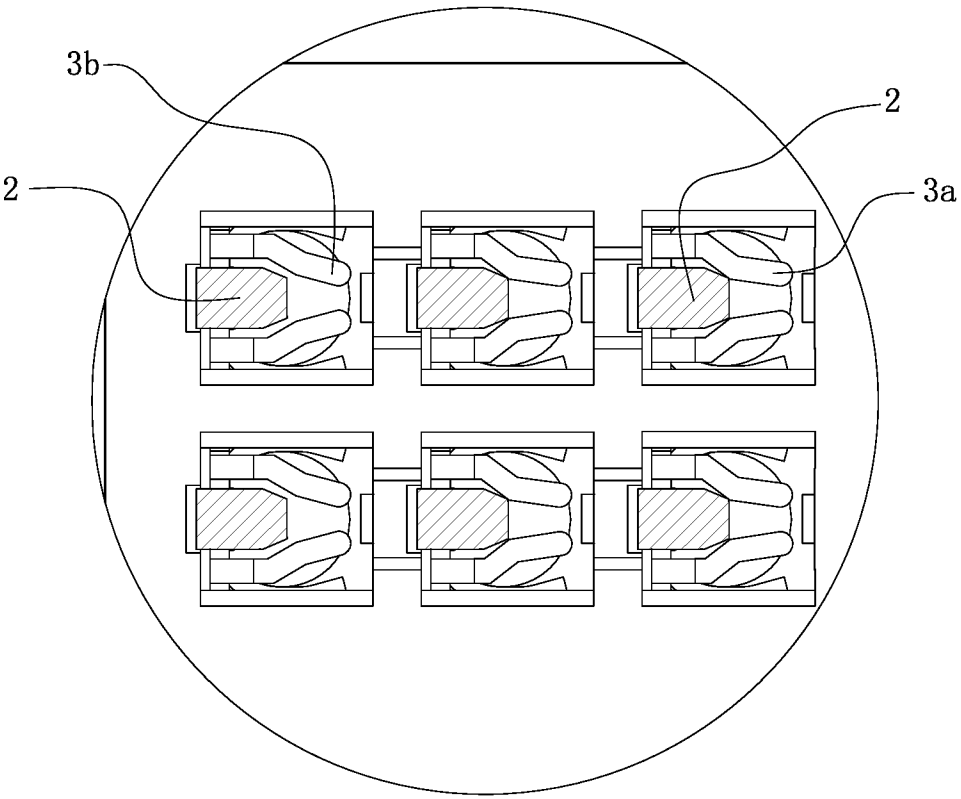
FIG. 20 is a schematic view of a first terminal clamping the conducting portion first and then the second terminal clamping the conducting portion according to a second embodiment of the present invention.

FIG. 20 shows a second embodiment of the present invention, which is different from the first embodiment in that the terminals 3 include a first terminal 3*a* and a second terminal 3*b*, and the first terminal 3*a* is a ground terminal. In other embodiments, the first terminal 3*a* is a power terminal, or multiple first terminals 3*a* are provided, including a ground terminal and a power terminal. The first terminal 3*a* and the second terminal 3*b* have different structures. That is, after the conducting portion 2 is respectively inserted downward between the two guide portions 33 of the corresponding first terminal 3*a* and the second terminal 3*b*, a distance between the two contact portions 32 of the first terminal 3*a* and the corresponding conducting portion 2 is less than a distance between the two contact portions 32 of the second terminal 3*b* and the corresponding conducting portion 2. In the process of the conducting portion 2 moving forward, the first terminal 3*a* clamps the conducting portion 2 first and then the second terminal 3*b* clamps the conducting portion 2. Other structures and functions of this embodiment are completely identical to those in the first embodiment, and thus are not further elaborated herein.

Figure 21:
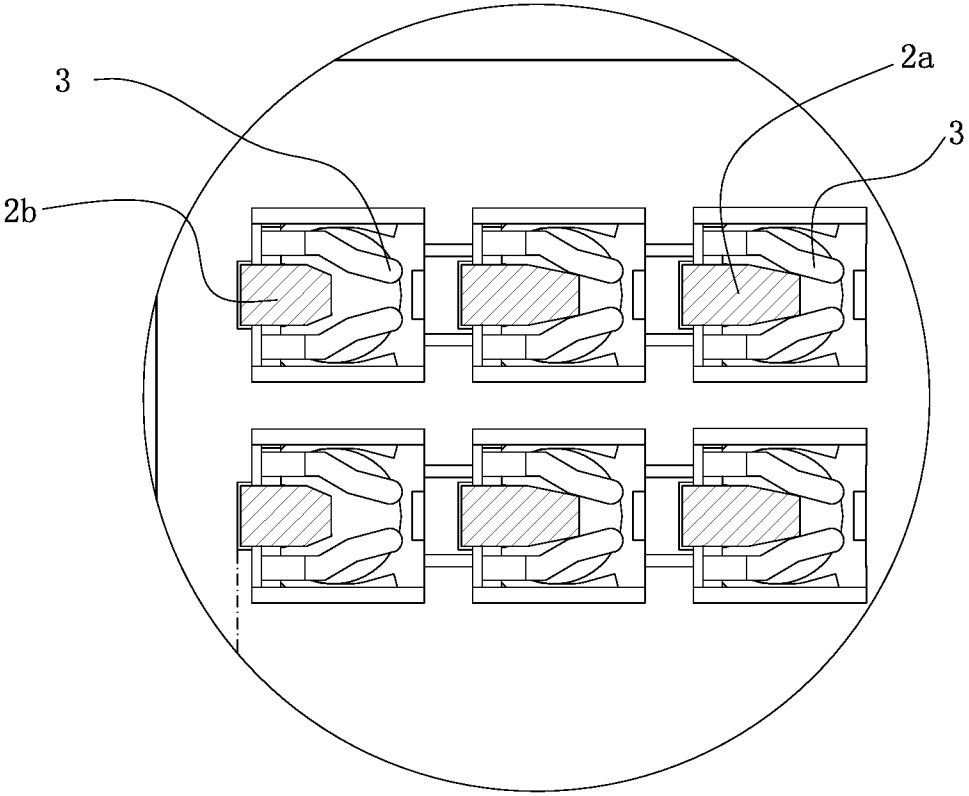
FIG. 21 is a schematic view of a first conducting portion being clamped by the terminal first and then a second conducting portion being clamped by the terminal according to a third embodiment of the present invention.

FIG. 21 shows a third embodiment of the present invention, which is different from the first embodiment in that the conducting portions 2 include a first conducting portion 2*a* and a second conducting portion 2*b*. A width of the first conducting portion 2*a* in the front-rear direction is greater than a width of the second conducting portion 2*b* in the front-rear direction. After the first conducting portion 2*a* and the second conducting portion 2*b* are respectively inserted downward between the two guide portions 33 of the corresponding terminal 3, a distance between the first conducting portion 2*a* and the contact portion 32 of the corresponding terminal 3 is less than a distance between the second conducting portion 2*b* and the contact portion 32 of the corresponding terminal 3 in the front-rear direction. In the process of the first conducting portion 2*a* and the second conducting portion 2*b* moving forward, the first conducting portion 2*a* is in contact with the contact portions 32 of the corresponding terminal 3 first and then the second conducting portion 2*b* is in contact with the contact portions 32 of the corresponding terminal 3. In this embodiment, the terminal 3 for clamping the first conducting portion 2*a* is a ground terminal. In other embodiments, the terminal 3 may be a power terminal, or multiple terminals 3 are provided for clamping the first conducting portion 2*a*, including a ground terminal and a power terminal. Other structures and functions of this embodiment are completely identical to those in the first embodiment, and thus are not further elaborated herein.

Figure 22:
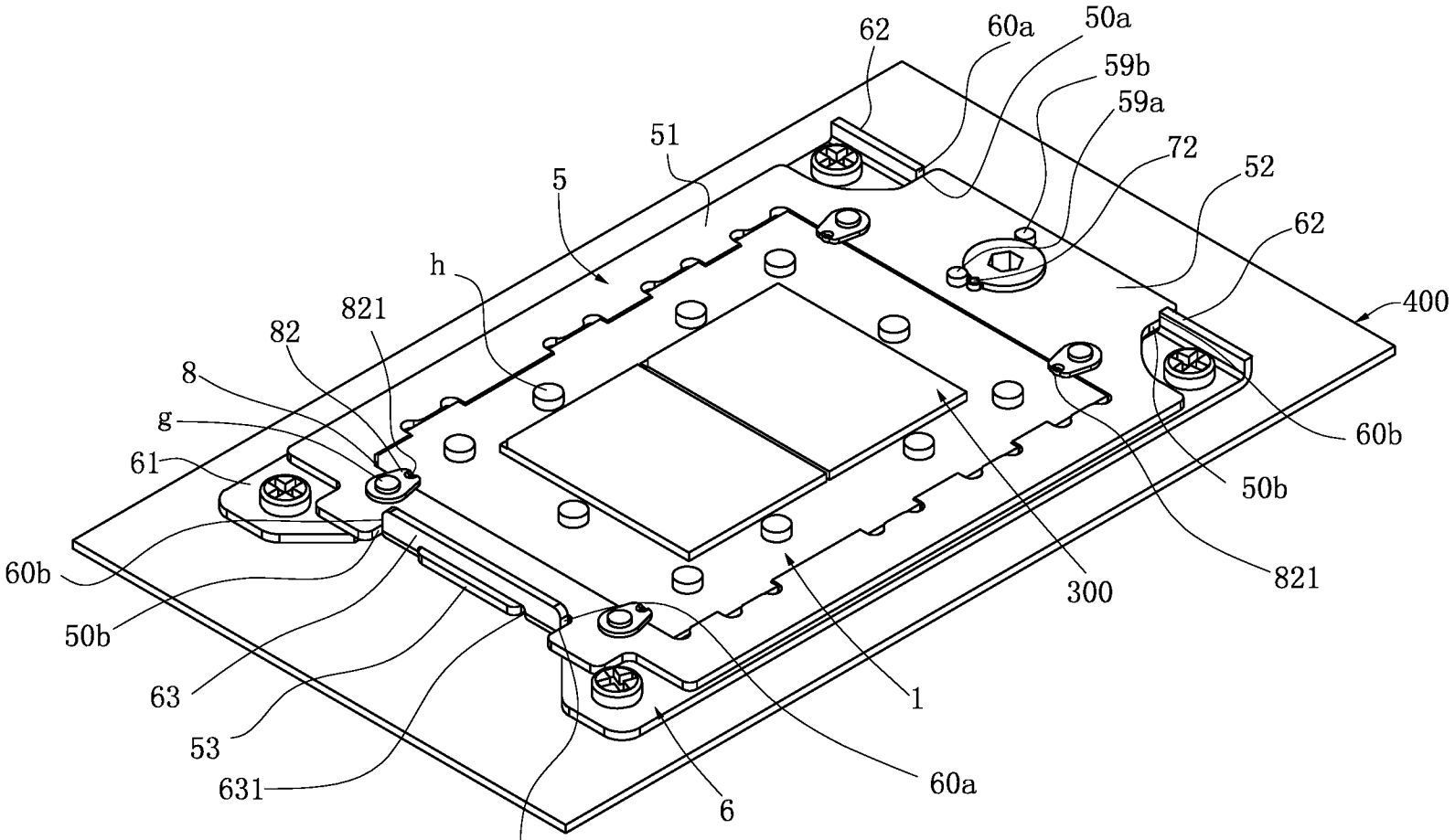
FIG. 22 is an assembled view of an electrical connector assembly according to a fourth embodiment of the present invention.
Figure 23:
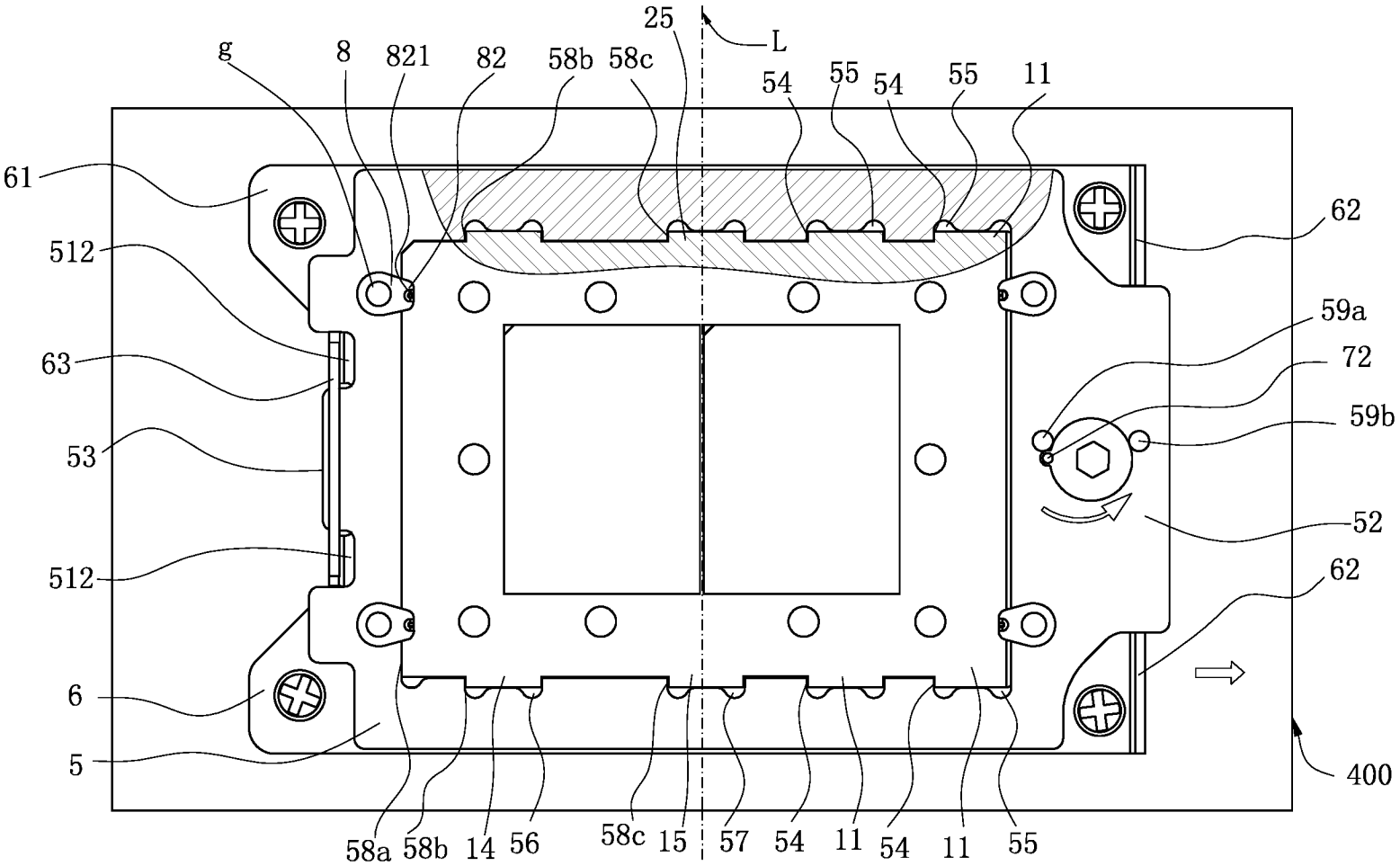
FIG. 23 is a top view of FIG. 22.

FIGS. 22 and 23 show a fourth embodiment of the present invention, which is different from the first embodiment in that the cover 5 further has two second abutting portions 58*b* and two third abutting portions 58*c*, which are all located behind the virtual center line L of the hollow portion 511. The left and right sides of the hollow portion 511 are respectively recessed to form two notches 56. The left and right sides of the substrate 1 are respectively provided with two projecting portions 14 respectively accommodated in the notches 56. A rear side surface of each notch 56 forms the second abutting portion 58*b* which abuts the projecting portions 14 located in front thereof. The left and right sides of the hollow portion 511 are respectively recessed to form two recess portions 57. A front side surface of each recess portion 57 is located at the front side of the virtual center line L, and a rear side surface of each recess portion 57 is located at the rear side of the virtual center line L. The left and right sides of the substrate 1 are provided with two projecting blocks 15 respectively accommodated in the recess portions 57, and a rear side surface of each recess portion 57 forms the third abutting portion 58*c* which forward abuts the projecting blocks 15 located in front thereof. When the cover 5 moves horizontally forward, the pulling portion 54 pulls the substrate 1 to move horizontally forward, and the first abutting portions 58*a*, the second abutting portions 58*b* and the third abutting portions 58*c* push the substrate 1 to move horizontally forward altogether, so as to drive the conducting portion 2 to move from the guide portions 33 to be clamped by the contact portions 32 of the corresponding terminal 3. The protruding block 72 horizontally rotates from the first stopping position 59*a* toward the second stopping position 59*b* in a different direction. That is, the rotating direction thereof is clockwise in the first embodiment, and counterclockwise in this embodiment. Moreover, in this embodiment, an angle at which the protruding block 72 horizontally rotates from the first stopping position 59*a* toward the second stopping position 59*b* is greater than 180°, such that the driving member 7 drives the cover 5 more easily. The rear bending portion 63 is provided with a through hole 631 running through the rear bending portion 63 in the front-rear direction, and the through hole 631 has a top surface. A protruding portion 53 extends backward from one side of the slide slot 512. The protruding portion 53 is located between the left side and the right side of the slide slot 512, and the protruding portion 53 enters the through hole 631, such that the top surface of the through hole 631 limits the cover 5 from moving upward. The substrate 1 is provided with multiple supporting columns h for supporting a heat sink (not shown). The pressing portion 82 is provided with a bump 821 protruding downward, and the bump 821 abuts the substrate 1 downward. Other structures and functions of this embodiment are completely identical to those in the first embodiment, and thus are not further elaborated herein.

To sum up, the electrical connector assembly 200 according to certain embodiments of the present invention has the following beneficial effects:

(1) The pulling portion 54 is provided in front of the virtual center line L, and the pulling portion 54 pulls the substrate 1 forward. That is, the force received by the substrate 1 to drive it to move forward is a pulling force, such that the warpage of the substrate 1 during the moving of the mating plug 100 can be avoided.

(2) In the process of the substrate 1 moving forward, a pulling force from the pulling portion 54 acts on the substrate 1 in front of the virtual center line L and a pushing force from the first abutting portions 58*a*, the second abutting portions 58*b* or the third abutting portion 58*c* acts on the substrate 1 behind the virtual center line L, so as to jointly push the substrate 1 to move horizontally forward. Thus, the force acting on the substrate 1 is more uniform during the forward moving process, and the warpage of the substrate 1 during the movement can be avoided.

(3) The distance between the two contact portions 32 of the first terminal 3*a* and the conducting portion 2 is less than the distance between the two contact portions 32 of the second terminal 3*b* and the conducting portion 2 in the front-rear direction. In the process of the conducting portion 2 moving forward, the two contact portions 32 of the first terminal 3*a* clamp the conducting portion 2 first, and then the two contact portions 32 of the second terminal 3*b* clamp the conducting portion 2, such that the force when the conducting portion 2 is in contact with the contact portion 32 is dispersed, thereby reducing the driving force required for driving the cover 5 by the driving member 7.

(4) The width of the first conducting portion 2*a* is greater than the width of the second conducting portion 2*b* in the front-rear direction. In the process of the conducting portion 2 moving forward, the first conducting portion 2*a* is clamped by the terminal 3 first, and then the second conducting portion 2*b* is clamped by the terminal 3, such that the force when the conducting portion 2 is in contact with the contact portion 32 is dispersed, thereby reducing the driving force required for driving the cover 5 by the driving member 7.

(5) The plate edge of the flat plate portion 51 is provided with a first slide track 50*a* and a second slide track 50*b* respectively extending in the front-rear direction. The first slide track 50*a* abuts the first mating edge 60*a* leftward, and the second slide track 50*b* abuts the second mating edge 60*b* rightward. The size can be more precise and the left and right offset of the cover 5 can be reduced since the first slide track 50*a* and the second slide track 50*b* are formed by the plate edge of the flat plate portion 51. Thus, the mating plug 100 moves horizontally forward more stably, so as to ensure good connection between the conducting portion 2 and the terminal 3.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured to be electrically connected to a mating plug, the mating plug being provided with a substrate and a plurality of conducting portions protruding downward from the substrate, and the electrical connector comprising:

an insulating body;

a plurality of terminals, respectively accommodated in the insulating body, wherein each of the terminals is provided with a contact portion;

a cover, covering the insulating body in a front-rear sliding manner and having a hollow portion to accommodate the substrate, wherein the hollow portion has a virtual center line extending in a left-right direction, the cover is provided with a pulling portion to abut the substrate forward, and the pulling portion is located in front of the virtual center line; and a driving member, provided with a driving portion located in front of the hollow portion, wherein after the substrate of the mating plug is mounted downward into the hollow portion, the driving portion drives the cover to move horizontally forward relative to the insulating body, and the pulling portion pulls the substrate forward, such that the conducting portions move forward to be in contact with the contact portions of the terminals.

2. The electrical connector according to claim 1, wherein a left side and a right side of the hollow portion are recessed to form a plurality of concave portions, a left side and a right side of the substrate are provided with a plurality of protrusion portions correspondingly accommodated in the concave portions, a rear side surface of each of the concave portions forms the pulling portion, and the pulling portion abuts the protrusion portions in front thereof.

3. The electrical connector according to claim 1, wherein a rear side of the hollow portion forms an abutting portion, and when the cover moves horizontally forward, the abutting portion abuts a rear side of the substrate forward.

4. The electrical connector according to claim 1, wherein a left side and a right side of the hollow portion are recessed to form a plurality of notches, a left side and a right side of the substrate are provided with a plurality of projecting portions correspondingly accommodated in the notches, a front side surface of each of the notches is located behind the virtual center line, a rear side surface of each of the notches forms an abutting portion, and when the cover moves horizontally forward, the abutting portion abuts the projecting portions located in front thereof.

5. The electrical connector according to claim 1, wherein a left side and a right side of the hollow portion are recessed to form a plurality of recess portions, a front side surface of each of the recess portions is located in front of the virtual center line, a rear side surface of each of the recess portions is located behind the virtual center line, a left side and a right side of the substrate are provided with a plurality of projecting blocks correspondingly accommodated in the recess portions, the rear side surface of each of the recess portions forms an abutting portion, and when the cover moves horizontally forward, the abutting portion forward abuts the projecting blocks located in front thereof.

6. The electrical connector according to claim 1, wherein a plurality of pressing sheets are located at two opposite sides of the hollow portion, each of the pressing sheets has a pivoting portion pivotally connected to the cover and a pressing portion extending from the pivoting portion, when the substrate is to be placed in the hollow portion, the pressing sheets are rotated such that the pressing portions thereof leave the hollow portion, and after the substrate is placed in the hollow portion, the pressing sheets are rotated such that the pressing portions thereof are pressed against an upper surface of the substrate.

7. The electrical connector according to claim 1, wherein each of the terminals is provided with two contact portions provided opposite to each other in the left-right direction, the two contact portions extend backward and away from each other to form two guide portions, two of the terminals comprise a first terminal and a second terminal, after a respective conducting portion of the conducting portions is inserted downward between the two guide portions of a corresponding terminal of the terminals, a distance between each of the two contact portions of the first terminal and the respective conducting portion is less than a distance between each of the two contact portions of the second terminal and the respective conducting portion in a front-rear direction, and in a process of the respective conducting portion moving forward, the two contact portions of the first terminal clamp the respective conducting portion first, and then the two contact portions of the second terminal clamp the conducting portion.

8. The electrical connector according to claim 1, further comprising a metal member, wherein the cover is made of metal and has a horizontal flat plate portion, and a plate edge of the flat plate portion is provided with a first slide track and a second slide track respectively extending in a front-rear direction; a plate edge of the metal member is provided with a first mating edge corresponding to a left side of the first slide track and a second mating edge corresponding to a right side of the second slide track, the first slide track abuts the first mating edge leftward, and the second slide track abuts the second mating edge rightward.

9. The electrical connector according to claim 8, wherein the hollow portion is provided on the flat plate portion, the flat plate portion has a slide slot located behind the hollow portion, a right side of the slide slot forms the first slide track, and a left side of the slide slot forms the second slide track; the metal member has a bottom wall, the bottom wall is provided with an accommodating space to accommodate the insulating body, the bottom wall bends upward to form a rear bending portion located behind the accommodating space, the rear bending portion is accommodated in the slide slot, a right side of the rear bending portion forms the first mating edge, and a left side of the rear bending portion forms the second mating edge.

10. The electrical connector according to claim 9, wherein the flat plate portion has a sliding block located in front of the hollow portion, a left side of the sliding block forms the first slide track, and a right side of the sliding block forms the second slide track; the bottom wall bends upward to form a front bending portion located in front of the accommodating space, the front bending portion is provided with a slot, the sliding block is accommodated in the slot, a left side of the slot forms the first mating edge, and a right side of the slot forms the second mating edge.

11. The electrical connector according to claim 9, wherein the rear bending portion is provided with a through hole running through the rear bending portion in a front-rear direction, and the through hole has a top surface; and the cover is further provided with a protruding portion entering the through hole, such that the top surface of the through hole limits the cover from moving upward.

12. The electrical connector according to claim 9, wherein the rear bending portion bends and extends backward to form an extending portion, and the flat plate portion is provided with a stopping surface located right below the extending portion to limit the cover from moving upward.

13. The electrical connector according to claim 9, wherein a plurality of supporting portions protrude upward from the bottom wall, and the supporting portions support the flat plate portion upward, such that a gap is formed between the bottom wall and the flat plate portion in a vertical direction.

14. The electrical connector according to claim 8, wherein the terminals are configured to be soldered to a circuit board, a back plate is located below the circuit board, the metal member is fixed to the back plate by a fixing member; a sleeve accommodates the driving member, the sleeve is provided with a fixing portion fixed in the circuit board, the fixing portion extends upward to form an upper portion accommodated in the metal member, and the fixing portion extends downward to form a lower portion accommodated in the back plate.

15. An electrical connector assembly, comprising:

a mating plug, provided with a substrate and a plurality of conducting portions protruding downward from the substrate; and an electrical connector, comprising:

an insulating body;

a plurality of terminals, respectively accommodated in the insulating body, wherein each of the terminals is provided with a contact portion;

a cover, covering the insulating body in a front-rear sliding manner and having a hollow portion to accommodate the substrate, wherein the hollow portion has a virtual center line extending in a left-right direction, the cover is provided with a pulling portion to abut the substrate forward, and the pulling portion is located in front of the virtual center line; and a driving member, provided with a driving portion located in front of the hollow portion, wherein after the substrate of the mating plug is mounted downward into the hollow portion, the driving portion drives the cover to move horizontally forward relative to the insulating body, and the pulling portion pulls the substrate forward, such that the conducting portions move forward to be in contact with the contact portions of the terminals.

16. The electrical connector assembly according to claim 15, wherein each of the terminals is provided with two contact portions provided opposite to each other in the left-right direction, the two contact portions extend backward and away from each other to form two guide portions, a front side of each of the conducting portions has an inclined surface, such that a width of each of the conducting portions gradually increases due to the inclined surface along a downward-from-top direction, after a respective conducting portion of the conducting portions is inserted downward between the two guide portions of a corresponding terminal of the terminals, the guide portions guide the respective conducting portion to move forward to the contact portions, and in a process of the respective conducting portion moving forward, the inclined surface of the respective conducting portion is in contact with the contact portions.

17. The electrical connector assembly according to claim 15, wherein each of the conducting portions has a mating surface for contacting the contact portion of a corresponding terminal of the terminals, and in a downward-from-top direction, the mating surface extends obliquely toward the contact portion of the corresponding terminal.

18. The electrical connector assembly according to claim 16, wherein a left side and a right side of each of the conducting portions are respectively provided with two blocking portions, and the guide portions or the contact portions of the corresponding terminal are buckled downward to the blocking portions of the respective conducting portion.

19. The electrical connector assembly according to claim 15, wherein an upper surface of the substrate has a plurality of conducting regions respectively correspondingly electrically connected to the conducting portions, the conducting regions are configured to be conductively connected to a plurality of electrical conductors of a chip module correspondingly, and a distance between two adjacent ones of the conducting portions is greater than a distance between two adjacent ones of the conducting regions.

20. The electrical connector assembly according to claim 15, wherein two of the conducting portions comprise a first conducting portion and a second conducting portion, a width of the first conducting portion is greater than a width of the second conducting portion in a front-rear direction, after the substrate of the mating plug is mounted downward into the hollow portion, a distance between the first conducting portion and the contact portion of a corresponding terminal of the terminals is less than a distance between the second conducting portion and the contact portion of the corresponding terminal in the front-rear direction, and in a process of the first conducting portion and the second conducting portion moving forward, the first conducting portion is in contact with the contact portion of the corresponding terminal first, and then the second conducting portion is in contact with the contact portion of the corresponding terminal.

* * * * *